US005409572A

United States Patent [19]

Kershaw et al.

[11] Patent Number: 5,409,572

[45] Date of Patent: Apr. 25, 1995

[54] HIGH SOFTNESS EMBOSSED TISSUE

[75] Inventors: Thomas N. Kershaw, Neenah; Anthony O. Awofeso, Appleton; Frank D. Harper, Neenah; Dinesh M. Bhat, Neenah; John H. Dwiggins, Neenah; Frederick W. Ahrens, Hortonville; Bruce W. Janda, Neenah, all of Wis.

[73] Assignee: James River Corporation of Virginia, Richmond, Va.

[21] Appl. No.: 226,118

[22] Filed: Apr. 11, 1994

Related U.S. Application Data

[63] Continuation of Ser. No. 107,039, Aug. 17, 1993, abandoned, which is a continuation of Ser. No. 641,656, Jan. 15, 1991, abandoned.

[51] Int. Cl.[6] ..... D21H 27/02

[52] U.S. Cl. ..... 162/109; 162/101; 162/112; 162/113; 162/125; 162/129; 162/130; 162/141; 162/149

[58] Field of Search ..... 162/101, 109, 111, 112, 162/113, 117, 123, 125, 129, 130, 141, 149

[56] References Cited

U.S. PATENT DOCUMENTS

| | | | |
|---|---|---|---|
| 3,994,771 | 11/1976 | Morgan, Jr. et al. | 162/113 |
| 4,100,017 | 7/1978 | Flaunt, Jr. | 162/111 |
| 4,300,981 | 11/1981 | Carstens | 162/111 |
| 4,488,932 | 12/1984 | Eber et al. | 162/101 |
| 4,795,530 | 1/1989 | Soerens etal. | 162/111 |
| 4,803,032 | 2/1989 | Schulz | 162/117 |
| 4,874,465 | 10/1989 | Cochrane et al. | 162/111 |

OTHER PUBLICATIONS

"The Significance of Coarseness in Papermaking" Publication S20 02.0-E of Katjaani Elec., Ltd. (1986), pp. 1-12.

*Primary Examiner*—Peter Chin

[57] ABSTRACT

A single or multi-ply tissue product includes at least one foam-formed ply incorporating at least about 100 ppm of forming-loop-incorporated surfactant, the ply includes from at least about 50% by weight to about 80% by weight of relatively short, high softness cellulosic fiber formed by chemical pulping of hardwood. The fibers have a weight average fiber length of between about 0.5 to about 2.2 mm, a coarseness of about 7 to about 14 mg of fiber per 100 m of fiber length (mg/100 m). The ply includes from at least about 20% by weight to about 50% by weight of relatively long strength-enhancing cellulosic fiber chosen from chemically pulped softwood fiber and chemi-thermo-mechanically pulped softwood fiber and mixtures thereof. The strength-enhancing cellulosic fiber have a weight average fiber length of about 2 to about 4 mm, a coarseness of about 14 to about 28 mg/100 m. Optionally, up to about 30% by weight of bulk-enhancing fibers having a three-dimensional anfractuous character may be provided. The ply is embossed to an emboss depth of at least about 0.020 inch, the percent loss in total dry breaking tensile strength upon embossing of the tissue being no more than about 80% of the percent loss in total dry breaking tensile strength upon embossing plies of a comparable conventional water formed tissue. The ply includes a basis weight of from about 4 to about 20 pound per 3,000 sq. ft. ream.

65 Claims, 6 Drawing Sheets

HIGH SOFTNESS EMBOSSED TISSUE

This application is a continuation of application Ser. No. 08/107,039, filed on Aug. 17, 1993, now abandoned, which is a continuation of application Ser. No. 07/641,656, filed on Jan. 15, 1991, now abandoned.

Esthetics and tactile considerations are extremely important for tissue products as they often come into intimate contact with the most delicate parts of the body in use. Consequently, demand is quite high for products with improved tactile qualities, particularly softness. However, as tissue products are frequently used to avoid contact with that which the consumer would greatly prefer not to touch, softness alone is not sufficient; strength is also required. Merely providing a product with improved properties is not generally sufficient, the "on the shelf" appearance of the product must suggest both strength and softness while consumers must be able to sense improvements by handling packaged product. Appearance is critical; bulk, weight, compressibility, firmness, texture and other qualities perceived as indicia of strength and softness are also required. Further, since tissue products are disposables, low cost is of paramount importance.

This application relates to embossed tissue products combining superior tactile properties with high strength which are produced at high speeds on specially built tissue machines employing foam as the carrier in the forming loop. Unexpectedly, it has been found that tissues of the present invention may be produced at low cost but even though superficially comparable to existing state-of-the-art products in unembossed form, in the embossed form, they possess exceptional softness and strength along with a surprisingly desirable combination of smoothness, formation, weight and luxurious appearance making them remarkably attractive to consumers.

Many ways are known for producing soft tissues. Some employ premium-priced ultra-fine fibers, such as eucalyptus, to achieve softness while others employ through-air drying processes which are known to be slow even for single ply products but are particularly costly for multi-ply products. The present tissues may be foam formed using commonplace fibers, rapidly dried in a conventional manner, then embossed achieving a combination of perceptible tactile properties and strengths surpassing those expected from previously known tradeoffs involved in production using lower cost fibers along with conventional high speed water forming and drying techniques. Of course, premium fibers such as eucalyptus can be employed to produce tissues having even more remarkable properties. Similarly, other softness-enhancing processes such as recreping and through-air drying may be used in the production of the present invention either with premium or lower cost fibers if it is desired to produce super-premium products, but none of these are necessary to produce state-of-the-art results. Embossed tissue of the present invention is characterized by high retained strength even at emboss depths which would severely weaken many prior art water formed tissues.

The products of the present invention are formed using a foamed furnish, preferably as described in co-pending commonly assigned pending application Ser. No. 07/599,149 then embossed to a depth of at least about 0.020 inch in registered pattern preferably having nested impressions formed in both faces. Foam formed tissues of the present invention exhibit a percent loss in strength of no more than about 80%, preferably no more than about 75%, of the percent loss in strength observed upon embossing a conventional water formed tissue having the same basis weight and unembossed strength to the same depth with the same pattern. Thus, for illustration, if the strength loss upon embossing of conventional water formed tissues is compared to that of comparable foam formed tissues of the present invention having the same structure, composition, basis weight and unembossed strength; and if the percent loss in strength of the conventional water formed tissues is about 10%, then the percent loss in strength upon embossing the tissues of the present invention with the same pattern to the same depth will be less than about 8% and the percent loss in strength of the preferred tissues of the present invention will be less than about 7.5%. In preferred embodiments, where the emboss is nested, the tissue retains at least about 80% of the strength of the unembossed tissue if embossed to a depth of about 0.060 in over 16% of its area while for a similar point-to-point emboss to a depth of 0.050 in., the embossed tissue retains at least about 65% of the strength of the unembossed tissue.

Calendered products of the present invention possess an exceedingly high degree of softness for their strength, while it appears that the uncalendered tissues of the present invention possess a softness at least roughly equivalent to that of calendered comparable conventional water formed tissues. A possible explanation for this may be related to the observation that the tissues of the present invention suffer a much lesser increase in stiffness upon calendering than do comparable conventional water formed tissues if both are calendered to the extent that machine direction stretch is reduced severely. In particular, it appears that the increase in geometric mean stiffness upon such severely stretch-reducing calendering of the tissues of the present invention is less than about 75% of that suffered by comparable conventional water formed tissues upon calendering to the same caliper. Throughout this application, the term "comparable conventional water formed tissue" shall be understood to comprehend tissues formed on paper machines operating at over 2000 feet per minute using water as the carrier in the forming loop in any of the usual commercial forming configurations such as twin wire, crescent, suction breast roll, open breast roll,conventional Fourdrinier and other well-known configurations, wherein the tissue has comparable structure in the sense of having the same number of plies, each ply being of the same basis weight, fiber composition, percent crepe and unembossed strength as the corresponding ply of the foam formed tissue. All comparisons referring to the loss in strength upon embossing should be understood to refer to embossing comparable tissues to the same depth of emboss using the same embossing pattern.

Tissue of the present invention will comprise: from at least about 50% to about 80% by weight of relatively short, high softness-enhancing cellulosic fiber; from at least about 20% to about 50% by weight of relatively long, strength-enhancing cellulosic fiber; optionally, up to about 40% of bulk-enhancing fibers having a three-dimensional or kinked character and from about 100 to about 500 ppm by weight of biological membrane contact compatible surfactant. The roll diameter of a 300 sheet roll having an area of about 42 square feet and a weight of 14.5 to 22.2 lbs/3000 square foot ream will preferably be at least about 4.2 to 4.8 inches, while the compression of the roll will be about 5% to 20% as measured by the roll compression test described herein.

The process of forming products of the present invention is superficially similar to that of water forming prior art tissues but uses specialized foam forming techniques to produce products having a surprising improvement in perceptible tactile properties upon embossing while retaining strength. The basic procedure of the preferred process for making tissues of the present invention is that described in co-pending U.S. patent application Ser. No. 07/599,149 entitled "Foam Forming Method and Apparatus" in the names of John H. Dwiggins and Dinesh M. Bhat using the procedure described in the pending application of Frederick W. Ahrens, Ser. No. 07/607/509, filed Nov. 1, 1990, entitled "Control of Headbox Jet Velocity for Foamed Furnishes" to control jet speed as described in the co-pending application of Bruce W. Janda, filed of even date herewith, entitled "High Purity Stratified Tissue and Method of Making Same" and pending application of Dinesh M. Bhat, Ser. No. 07/598,995, filed Oct. 17, 1990, entitled "Recovery of Surfactant From Papermaking Process". In our experience, this process is exceptionally tolerant and is capable of producing tissues of the present invention over a broad range of conditions while prior art foam forming techniques seem to be more temperamental. In the future, it may prove possible to form such tissues using these processes, but to date, we have not. Armed with the knowledge that it is possible to make such remarkable products and with the guidance of these three applications, incorporated by reference herein, as well as of the present application, the products of the present invention may be manufactured by adjusting the known parameters of the papermaking process to obtain products having the specified properties.

DETAILED DESCRIPTION OF THE PREFERRED EMBODIMENTS

Figure 1:
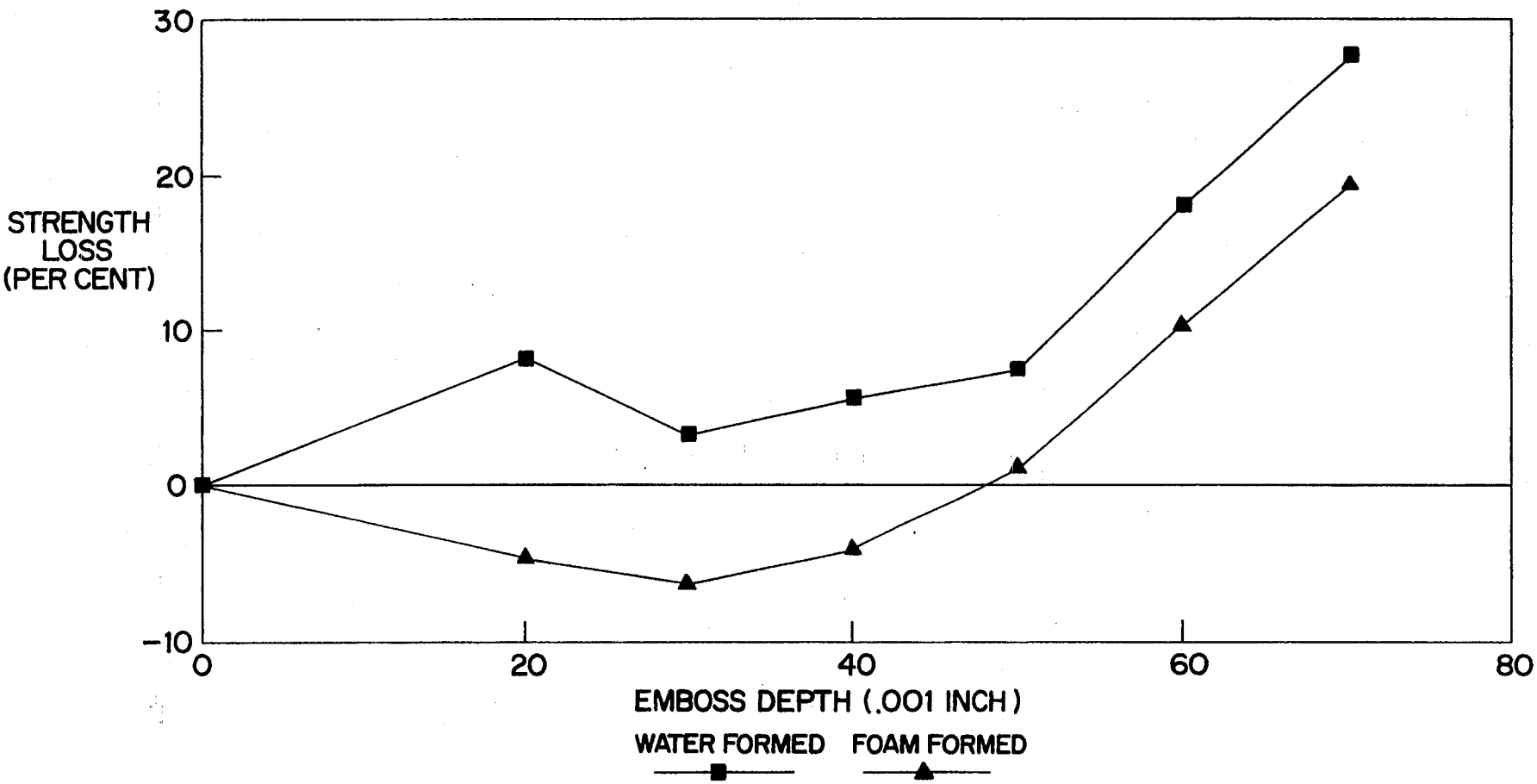
FIGS. 1 and 2 illustrate the dramatic differences between the embossing characteristics of tissues of the present invention and conventional water formed tissues by comparing the percent loss in strength of the two upon embossing with the same pattern to the same depth.

Tissues of the present invention comprise plies falling within two broad classes: homogeneous and stratified. Homogeneous plies are of relatively uniform composition and structure throughout while as would be expected stratified plies have strata of composition varying from the composition of other strata in the tissue.

Homogeneous tissues of the present invention comprise embossed plies of tissue comprising:

from at least about 50% to about 80% by weight of relatively short, high softness cellulosic fiber as for example: hardwood pulp, produced by straight chemical processes such as either the kraft or sulfite processes; said softness and opacity enhancing fibers having a weight average fiber length of between about 0.5 to about 2.2 mm, preferably between 0.5 and 1.7 mm, a coarseness of about 7 to about 14 mg of fiber per 100 m of fiber length (mg/100 m), preferably from 7 to 11 mg/100 m;

from at least about 20% to about 50% by weight of relatively long strength-enhancing cellulosic fiber such as for example: softwood pulp; produced either by chemical pulping or by chemi-thermo-mechanical pulping, said strength-enhancing cellulosic fiber having a weight average fiber length of about 2 to 4 mm, preferably from about 2.5 to about 3.5 mm, a coarseness of about 11–28 mg/100 m, preferably from about 14 to about 22 mg/100 m;

optionally, up to about 40% by weight of bulk-enhancing fibers having a three-dimensional, anfractuous or kinked character such as citric acid treated fiber produced as described in pending U.S. patent application Ser. No. 07/473,404, incorporated herein by reference; or commercially available bulk-enhancing fibers such as those sold by Weyerhaeuser as HBA, such bulk-enhancing fibers having a weight average fiber length of from about 0.5 to about 3.5 mm and a coarseness of from about 7 to about 27 mg/100 m. Optionally, recycled fibers may be included in any of these components so long as the fiber properties are within the specified ranges.

Plies of the stratified tissues of the present invention comprise more or less distinct zones of tissue wherein the layers intended to contact the user are relatively rich in soft short fibers while a separate zone imparts strength to the body of the tissue. The exterior stratum of the tissues should comprise:

from at least about 50%, preferably 60% by weight of relatively short, high softness cellulosic fiber as for example: hardwood pulp, produced by straight chemical processes such as either the kraft or sulfite processes; said softness and opacity enhancing fibers having a weight average fiber length of between about 0.5 to about 2.2 mm, preferably between about 0.5 and 1.7 mm, a coarseness of about 7 to about 14 mg of fiber per 100 m of fiber length (mg/100 m) preferably from 7 to 11 mg/100 m;

up to about 50% by weight, preferably no more than 40% of relatively long strength-enhancing cellulosic fiber;

while the supporting stratum of the tissues should comprise:

up to about 50%, preferably no more than 40% by weight of relatively short, high softness cellulosic fiber as for example: hardwood pulp, produced by straight chemical processes such as either the kraft or sulfite processes;

from at least about 50%, preferably about 60% by weight of relatively long strength-enhancing cellulosic fiber; and optionally, up to about 40% by weight of bulk-enhancing fibers having a three-dimensional, anfractuous or kinked character. As before, recycle may be included so long as the fiber properties are as set for the above.

Both stratified and homogeneous tissues desirably retain from at least about 100 ppm by weight to about 500 ppm by weight of a biological membrane contact compatible surfactant, incorporated in the forming loop, such as those disclosed in the previously mentioned Bhat and Dwiggins and Bhat applications. A number of surfactants suitable as a water additive for purposes of the present invention are available on the market, being generally classified as nonionic, anionic, cationic, or amphoteric. The surfactant concentration required usually will be in the range of 150 to about 1000 ppm by weight. A preferred nonionic surfactant is a peg-6 lauramide marketed under the tradename Mazamide L-5AC by Mazer Chemical Co., Chicago.

Selection of a class of surfactant is dependent upon chemical characteristics of such other additives as may be commonly used in the manufacture of fibrous webs. These other additives include, singly or in homogeneous mixtures thereof, latexes, binders, debonding agents, dyes, corrosion inhibiting agents, pH controls, retention aids, creping aids, additives for increasing wet strength or dry strength as well as other substances commonly used in papermaking processes.

U.S. Pat. Nos. 3,716,449 and 3,871,952 disclose specific nonionic, anionic, and cationic surfactants, including some classified as amphoteric surfactants, which are suitable for practice of the present invention. The disclosures of these patents are included by reference in the present application for their teachings of surfactant materials. It is to be understood that there are a number of other surfactant materials available which are capable of modifying the interfacial tension between water and gas or air to form a semi-stable foam suitable as aqueous carrier medium suitable for use in the process of this invention. Stabilizers may be added to control foaming. By "biological membrane contact compatible", we mean those surfactants which when incorporated into tissues used in normal manners as for example as wipes, do not provoke undue irritation or allergic reaction upon coming into contact with the delicate membranes of the human anatomy with which such tissues commonly come into contact in use. The most preferred surfactant is believed to be particularly appropriate in such regard being approved for use in such products as shampoos.

The strength-enhancing fibers found in tissues of the present invention may be chemically pulped softwood fibers, such as kraft or sulfite softwood pulps, chemi-thermo-mechanical softwood fibers and the like. The softness and opacity enhancing fibers found in tissues of the present invention may be chemically pulped hardwood fibers, such as those produced by the kraft or sulfite processes and the like.

Fiber used in the practice of the present invention should normally be refined to a lower freeness than would be expected for the formation of comparable water formed tissue, a minimum Canadian Standard Freeness of at least about 250 ml being preferred, with a CSF of over 450 ml being more preferred and the most preferred range being between about 500 ml and 600 ml CSF. The process of forming the products of the present invention seems to be quite sensitive to the freeness of the pulp, wide variations in tissue strength apparently resulting from variation of the degree of refining making it possible to obtain both excellent strength and strength retention upon calendering, embossing and combinations of the two.

Preferred tissue products of the present invention comprise at least two sheets embossed together, usually in such a fashion that optimum use may be made of the specific properties of each type of fiber. For example, stratified tissues may be embossed together in such a fashion that the strong softwood rich strata are in contact with each other between soft hardwood rich strata at the surface of the tissue. Surfactants have been previously incorporated into tissue products to improve various tactile properties, particularly softness, commonly with an attendant loss of strength. Therefore, in many cases, surfactants are called "de-bonding agents" as they are thought to weaken the bonds between fibers. Surprisingly, it has been found that, despite the presence of residual surfactant from the foam forming process, the tissues of the present invention retain a surprising degree of strength upon embossing making it possible to achieve a surprisingly favorable combination of softness, bulk and strength. The tissues of the present invention may thus be made softer at equal strength and basis weight, or made stronger at equal softness and basis weight or even of equal strength and softness at greatly reduced basis weight. In many cases, tissues of the present invention will be about 15% lower in basis weight than conventional water formed tissues of the same softness and strength. Surface texture, whether measured in terms of roughness or deviation in the coefficient of friction, as used herein, is a property of the region between the emboss and is to be measured only in those regions.

Softness is not a directly measurable, unambiguous quantity but rather is somewhat subjective. Bates has reported that the two most important components for predicting perceived softness are roughness and modulus referred to herein as stiffness modulus See J. D. Bates "Softness Index: Fact or Mirage?," TAPPI, vol. 48, No. 4, pp 63A–64A, 1965. See also H. Hollmark, "Evaluation of Tissue Paper Softness", TAPPI, vol. 66, No. 2, pp 97–99, February, 1983, relating tensile stiffness and surface profile to percieved softness. The tissues of the present invention will have a pleasing texture as measured by either root mean square roughness (weighted by the square of the difference in height between the profile and its mean) of less than about 0.020 mm as described below surface friction, preferably less than about 0.018 mm as measured using an Alpha-Step 200 profilometer, a stiffness modulus of less than about 25 g per % strain as determined by the procedure for measuring tensile strength as described herein except that the modulus recorded is the geometric mean of the slopes on the cross direction and machine direction load-strain curves from a load of 0 to 50 g/in and a sample width of 1 inch is used. All stiffness moduli referred to herein should be understood to be normalized to a basis weight of 15 lbs/3000 sq. ft. ream with the dimensions being expressed as g @ 50 g/in, % strain being, of course, dimensionless. Alternatively, surface texture can be evaluated by measuring geometric mean deviation (MMD) in the coefficient of friction using a Kawabata KES-SE Friction Tester equipped with a fingerprint type sensing unit at the low sensitivity and a load of 25 g stylus weight. Alternatively, surface roughness can be evaluated by measuring geometric mean deviation in the coefficient of friction using a Kawabata KES-SE Friction Tester equipped with a fingerprint type sensing unit using the low sensitivity range, a 25 g stylus weight and dividing the instrument readout by 20 to obtain the mean deviation in the coefficient of friction. The geometric mean deviation in the coefficient of friction is then, of course, the square root of the product of the MMD in the machine direction and the cross direction.

Formation of tissues of the present invention as represented by Kajaani Formation Index Number should be at least about 70, preferably about 75, more preferably at least about 80, and most preferably at least about 90, as determined by measurement of transmitted light intensity variations over the area of the sheet using a Kajaani Paperlab 1 Formation Analyzer which compares the transmitivity of about 250,000 subregions of the sheet. The Kajaani Formation Index Number, which varies between about 20 and 122, is widely used through the paper industry and is for practical purposes identical to the Robotest Number which is simply an older term for the same measurement. Tissues not containing bulk-enhancing additives should preferably have a higher Kajaani Formation Index Number of at least about 80. Comparable conventional water formed tissues will usually have Kajaani Formation Index Numbers of about 10 points under the comparable foam-formed tissues.

Unembossed strength of tissues of the present invention will be at least about 50, preferably at least about 75, and most preferably at least about 100 grams per lb/3000 sq ft ream of tissue as measured by adding the machine direction and cross direction tensile strengths as measured on an Instron Model 4000:Series IX using cut samples three inches wide, the length of the samples being the between perforation distance in the case of machine direction tensile and the roll width in the case of the cross direction and employing the 2 lb load cell with lightweight grips applied to the total width of the sample and recording the maximum load then dividing by the ratio of the actual sample length to the "normal" sample length of 3 inches. The results are reported in grams/3 inch strip.

In operation of foam forming for producing tissue of the present invention, if formation is not within the claimed ranges, the following non-limiting guidelines should be checked to bring formation above the desired minimum: the headbox should be brought as close as practicable to the forming zone to closely control jet stability and minimize jet break-up; the top of the headbox slice should be parallel to the drainage fabric to further control jet stability; the fabric lead-in roll should be dropped as low as practicable to insure that it does not contribute to excessive drainage; the fabric tension should be controlled and thereby the drainage rate controlled as good formation is strongly dependent on the proper drainage rate, both excessive and slow drainage rates leading to poor formation; the slice opening should be carefully monitored to insure that the consistency is within the preferred range listed in the Dwiggins and Bhat application; in some cases, it happens that stock consistency in all layers should be kept closely matched in the case of a stratified headbox, but in other cases, some mismatch may be desirable; air content of the furnish should be maintained at a minimum of around 60%; pressure pulsations in the forming loop should be carefully controlled, if not totally eliminated; and the headbox leaves should be positioned to limit jet breakup and mixing.

Surprisingly, when consumers compare tissues of the present invention to water formed tissues of equal softness and equal measured strength, they report that they feel that the water formed tissue is significantly stronger, presumably because the weight of a water formed tissue is so much greater. Thus it appears that the tissues of the present invention are not only surprisingly strong, they are so strong for their weight that consumers have difficulty perceiving that two tissues could be of equal strength when one is so much lower in basis weight than the other.

The uncreped basis weight of each ply of the sheet is desirably from about 4 to about 20 lbs/3000 sq ft ream, preferably from about 8 to about 20 for single ply sheets and preferably from about 4 to about 10 for plies for multi-ply sheets, more preferably from about 6 to about 8 for each ply in a multi-ply structure. Conventionally dried plies of the present invention are of surprisingly high creped caliper for their basis weight having a creped but uncalendered caliper of from about 0.020 to about 0.080 inches per 8 plies of tissue, the more preferred tissues having a caliper of from about 0.025 to about 0.050, the most preferred tissues having a caliper of from about 0.035 to about 0.045. Through-air dried single ply tissues of the present invention have a creped but uncalendered caliper of from about 0.035 to about 0.100 inches per 8 plies of tissue, the more preferred tissues having a total caliper of from about 0.065 to about 0.090, the most preferred tissues having a caliper of from about 0.070 to about 0.080. If it is desired to make through-air dried multi-ply sheets, each should have a caliper of from 0.035 to 0.065, preferably from 0.04 to 0.05. Calendering in usual commercial practice reduces the caliper by from about 20 to 35%.

When plies of these tissues are embossed together, an emboss depth of at least about 0.020 inch should be used for nested embossing. For point-to-point embossing or a combination of point-to-point and nested embossing, preferably, a depth of emboss of at least about 0.030 inch, more preferably about 0.040, and most preferably about 0.050 inch depth of emboss will be used to impart an especially luxurious appearance suggesting ultra-high softness. Tissues of the present invention will be embossed over at least about 10% of their area and more preferably will bear an emboss pattern over at least about 15% up to about 30% of their area. When wound onto a standard $1\frac{5}{8}$ inch core, the tissues of the present invention will have a diameter of at least about 4.2 to about 5.0 inches per 300 sheet roll having an area of 42.2 sq. ft. at a basis weight of between about 14.5 and 22.2 lbs./3000 sq. ft. ream, the preferred tissues of the present invention will have a diameter of at least about 4.2 to 4.8 inches while the most preferred tissues of the present invention will have a diameter of at least about 4.3 to 4.6.

Roll compression is measured by first measuring precisely the diameter of an intact roll (di) (no sheets removed, cylindrical undamaged core), placing the roll with its axis horizontal on a platform under a movable platen maintained horizontally and measuring the diameter of the roll as compressed under a 1500 g weight (dc), then roll compression is $di-dc/di\times 100\%$.

In many cases, it will be desirable to incorporate starch into the tissue as a dry-strength agent. Suitable starches are well known and include vegetable starches particularly corn, potato and wheat starches which increase dry strength without unduly degrading product softness and caliper. The starch may be added to either the thick or thin stock depending on system chemistry or degree of refining in an amount usually between about 0.1 to about 1% based on the dry weight of the fiber.

EXAMPLES

Example 1

To illustrate the remarkable properties of the foam formed tissues of the present invention, in particular the surprisingly high retained strength of these tissues after embossing, samples of tissues were formed by both foam forming techniques as described in pending U.S. patent application Ser. No. 07/599,149 as well as by water forming.

The sheets were made on a high-speed pilot machine (HSPM). The machine was in a crescent former configuration. The forming fabric was an Asten 94 M, the felt an Albany Superfine Triovent. The machine (yankee) speed was 3000 fpm and the % crepe was targeted at 20%. The sheets consisted of 50% northern softwood kraft (SWK) and 50% northern hardwood kraft (HWK). The sheets were formed fully stratified with all the HWK on the Yankee dryer side. The sheets were creped from the yankee using a 15 degree beveled creping blade. The Yankee coating was a mixture of Houghton 8203 adhesive and Houghton 565 mineral release oil. The sheets were calendered through a single nip to a target caliper of 30 mils/8 sheets. The target basis weight was 8.5 lbs/3000 sq ft; the target reel moisture was 4%. Refining of the SWK was used to control the strength of the sheets. The sheets made using foam forming technology were made with a target foam air content of 62%.

The resulting tissue base sheet had the following analysis and physical properties:

Units: Basis Wt = lbs/3000 sq ft; Caliper = mils/8 sheets; Tensiles = grams/3 inch strip; Stretch = %

| Method of Forming | Basis Weight | Caliper | MD Tensile | CD Tensile | % MD Stretch | % CD Stretch | Kaj. Form. |
|---|---|---|---|---|---|---|---|
| Water | 8.8 | 26.8 | 860 | 483 | 18.2 | 4.3 | 77.5 |
| | 8.7 | 25.9 | 865 | 448 | 18.3 | 4.3 | 78.2 |
| Foam | 8.4 | 32.2 | 801 | 427 | 26.5 | 4.6 | 92.0 |
| | 8.6 | 31.7 | 744 | 462 | 24.2 | 4.5 | 91.3 |

The sheets used were embossed on a 12-inch pilot emboss line at a speed of approximately 70 fpm. The embossing pattern was that shown in FIG. 6. The sheets were embossed in both nested and point-to-point configurations. In the nested emboss configuration, the sheets are plied together and the joined sheets are passed through a nip between an engraved emboss roll and a rubber-covered backing roll. For the point-to-point embossing, each sheet is passed through a nip consisting of an engraved embossing roll and a backing roll. The two sheets are then joined together in such a way that the patterns formed in the sheets by the embossing nips match. For both of the embossing methods, the embossing was done at various emboss depths. These depths were set by adjusting the penetration depth, which is the distance which backing roll travels after contacting the emboss element when the nip is closed. The emboss depths for this experiment were varied from 0.02 inch to 0.07 inch in increments of 0.01 inch.

Figure 6:
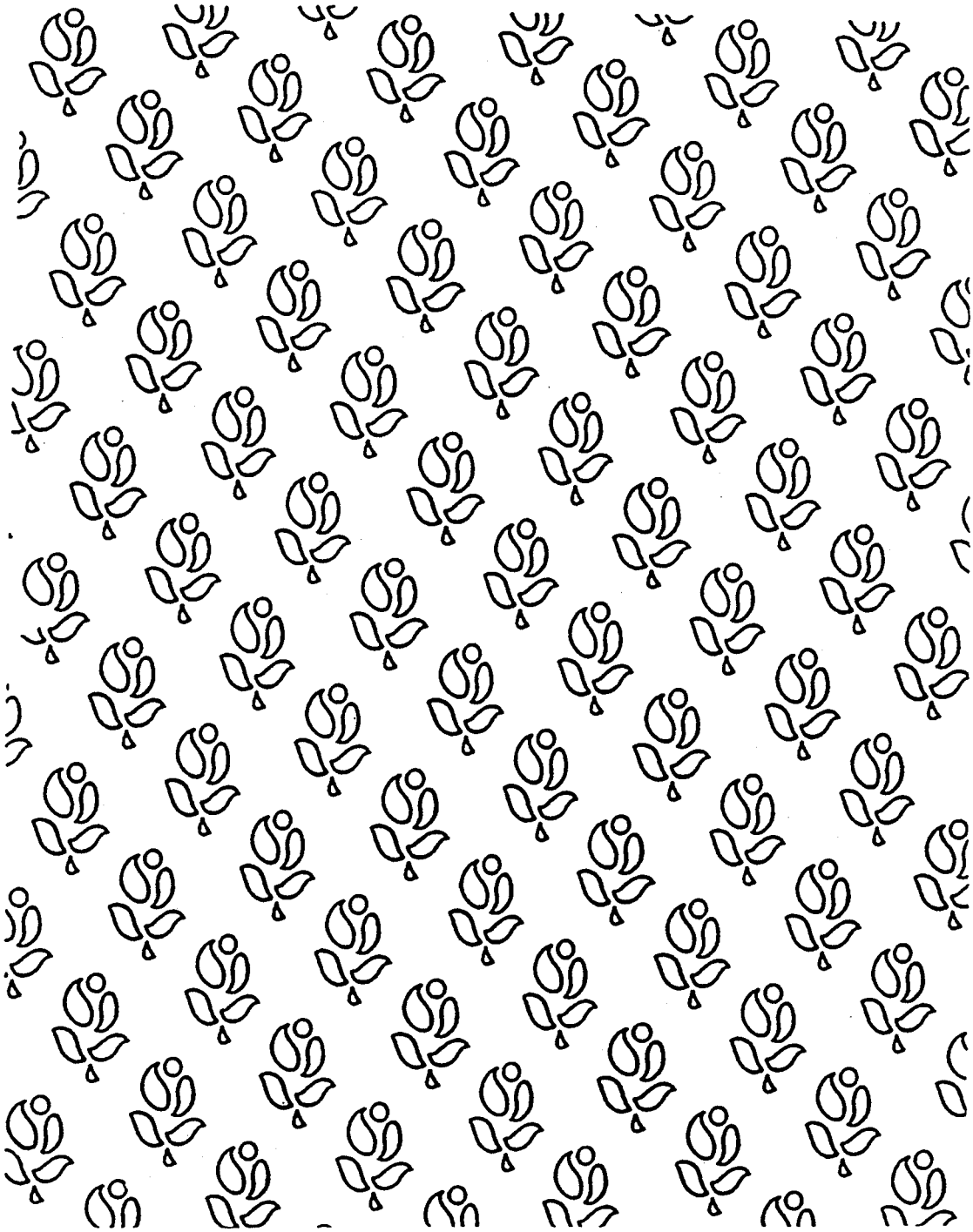
FIG. 6 illustrates a preferred embossing pattern for tissue of the present invention.

Multi-ply products were formed from these tissues by embossing 2 plies together to depths ranging from 0.020 to 0.070 inch using the embossing pattern illustrated in FIG. 6. Photomicrographs were taken optically at a magnification of 8× using low angle illumination to illustrate the details of the visual appearance of the embossed pattern of the samples produced at a die depth of 0.070 inch.

Figure 2:
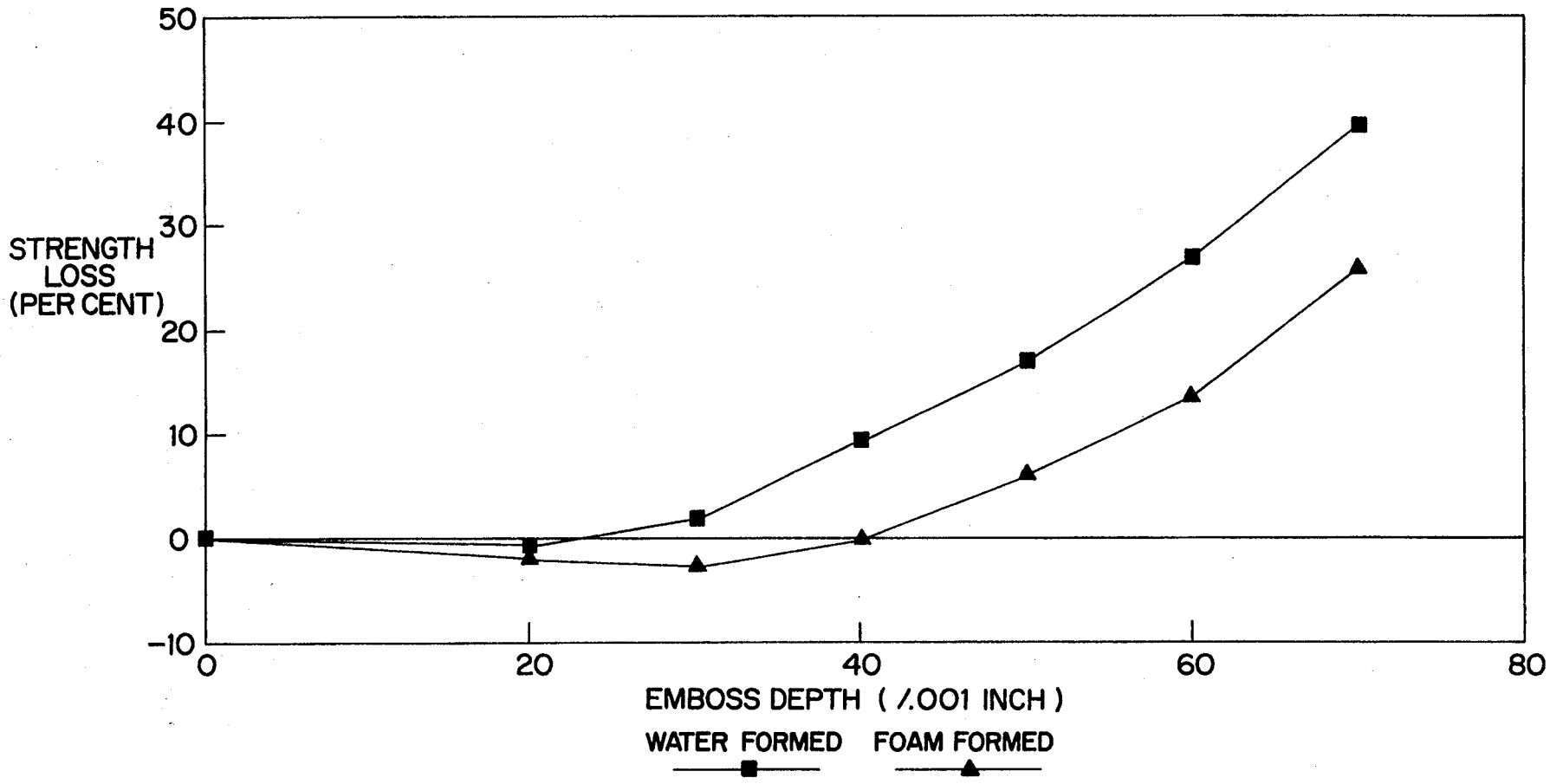

Tensile strengths were measured for each of the samples using the procedure described above, the averaged results of two independent measurements being presented in terms of percent loss in strength on FIG. 1 for the case where the patterns were embossed in a nested pattern and on FIG. 2 for a point-to-point pattern. It can be seen that the foam formed tissues of the present invention actually seem to gain strength from embossing up to a depth of about 0.050 inch in the case of the nested emboss and up to about 0.040 inch in the case of the point-to-point. While not large, the gain appears not to be an artifact of the testing but, in any event, it is certainly clear that the foam formed tissues of the present invention maintain their strength remarkably well appearing to suffer a loss of less than 80% of the loss in strength suffered by the comparable conventional water formed tissue.

Figure 3:
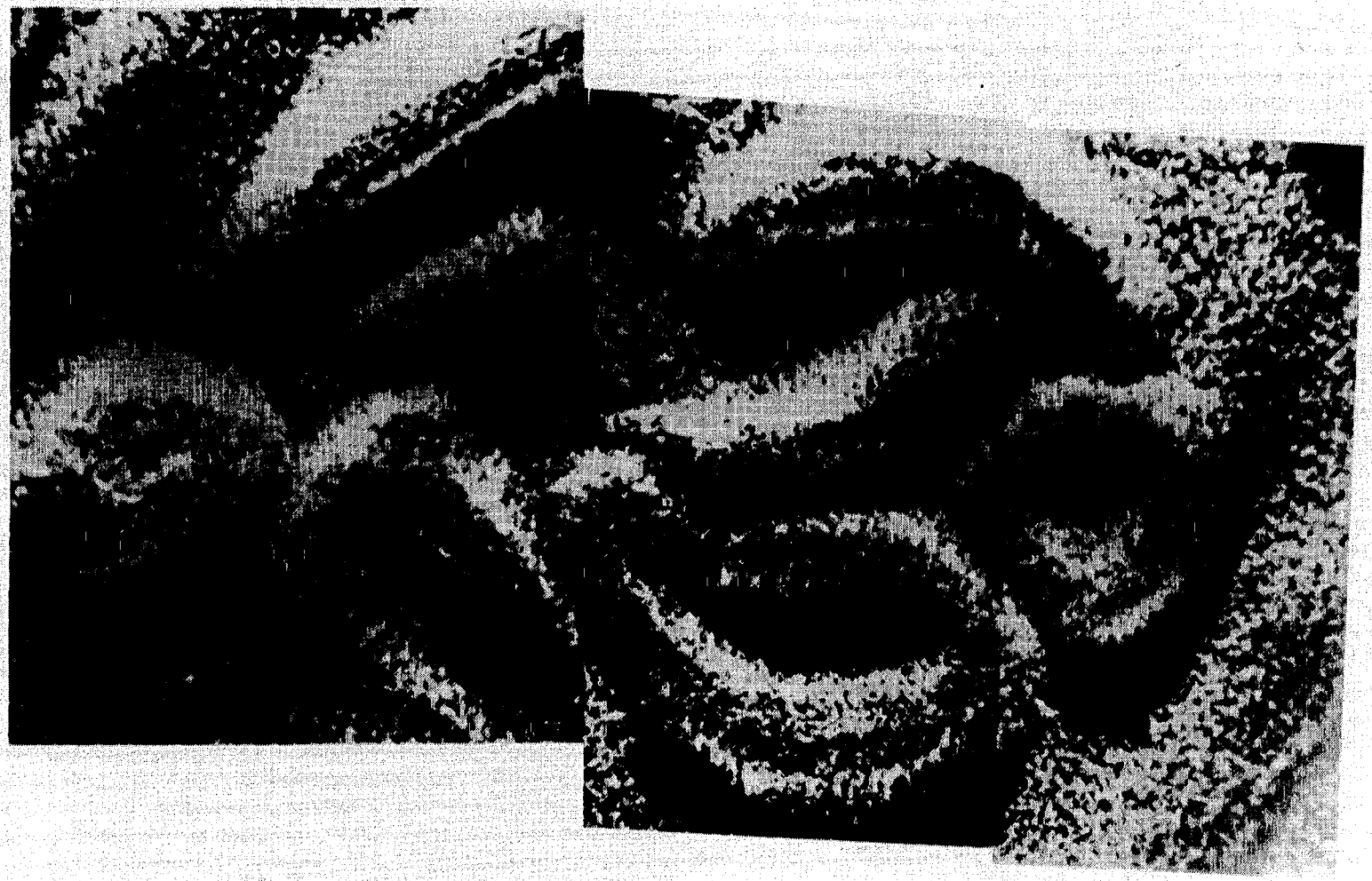
FIGS. 3 and 4 are low angle light photographs illustrating the dramatic differences between the character of the embossed areas of tissues of the present invention and comparable conventional water formed tissue.
Figure 4:
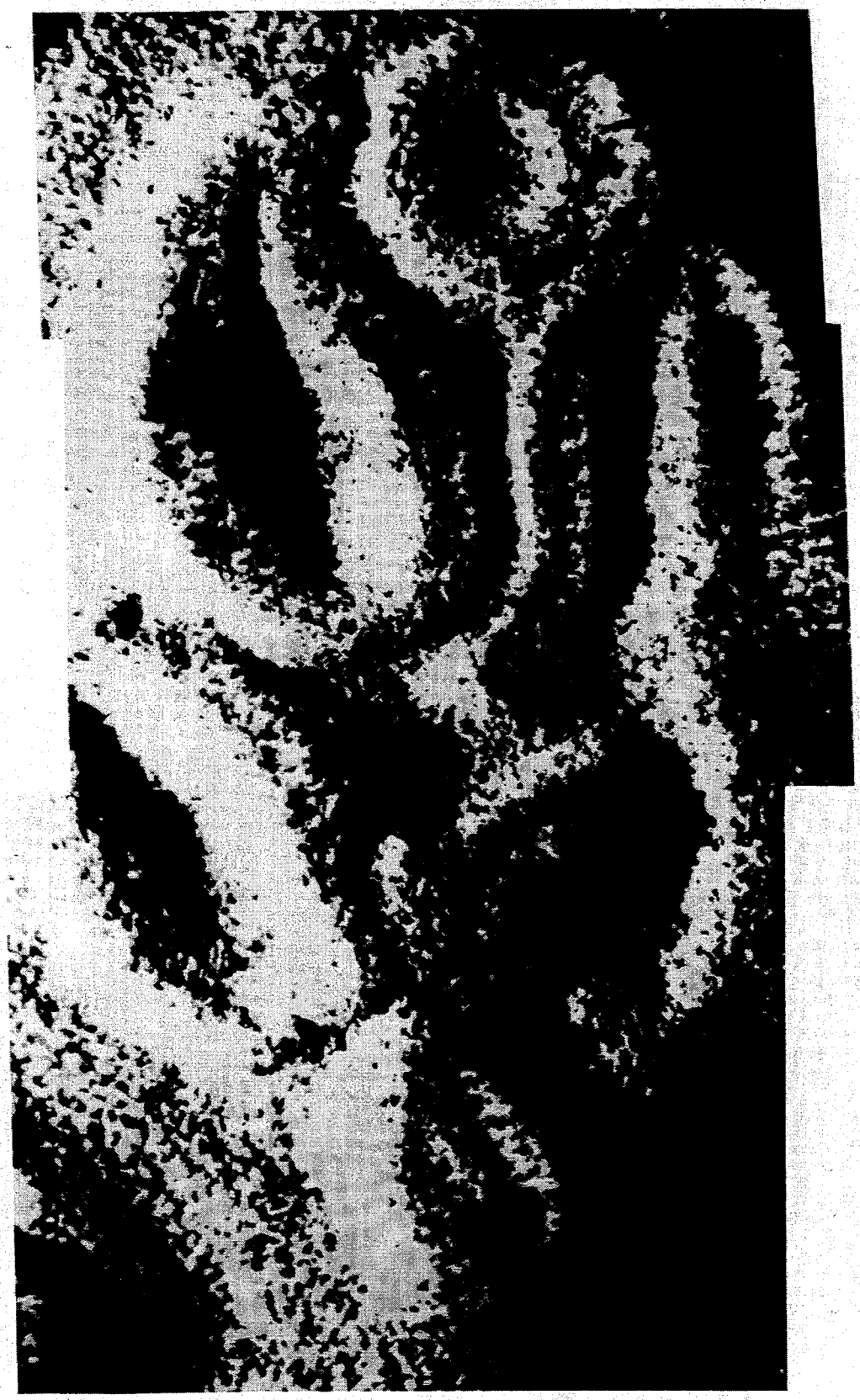

FIG. 3 is the optical photomicrograph of the foam formed tissue illustrating higher caliper in embossed areas as evidenced by the longer shadows observable in the photomicrographs indicating higher features as compared to the water formed tissue of FIG. 4. Cross-section of nested embossed tissues revealed that the 0.070 inch emboss depth foam formed tissue had an apparent bulk of 146 microns, a percent void area of about 5, and a base sheet caliper of 43 microns, while the water formed tissue nested embossed to a depth of 0.070 inch, had an apparent bulk of 124 microns, and a percent void area of about 2, and a base sheet caliper of 40 microns. Also apparent are the superior small feature detail of foam formed tissue. Also apparent in the water formed tissues are the large number of small holes in the water formed tissue wherein it appears that connecting fibers may have been broken. It is considered likely that the presence of these small holes in the water formed tissue may be related to its more pronounced loss of strength or, conversely, that an unexpected property of the foam formed tissue may inhibit formation of such holes contributing to its surprising strength retention. Although not apparent in FIGS. 3 and 4, it was also observed that the embossing of the water formed tissue was more variable than that of the foam formed tissue in regard to both caliper and pattern. It is hypothesized that this non-uniformity may also be contributing to the relative weakness of the highly embossed water formed tissue as compared to the foam formed. In practice, the difference between the two tissues will be rather greater than that which might be expected from observation of FIG. 1, as not only do the foam formed tissues lose less strength upon embossing, but also, due to the greater uniformity and more pronounced retention of emboss observable in the photomicrographs, to obtain the same enhanced appearance, the foam formed tissues do not need to be embossed as deeply as the water formed to obtain the same depth of resulting pattern.

Example 2

The sheets were made on the high-speed pilot machine (HSPM). The machine was in a crescent former configuration. The forming fabric was an Asten 94 M, the felt an Albany Superfine Triovent. The machine (yankee) speed was 3000 fpm and the % crepe was targeted at 20%. The sheets consisted of 50% Northern SWK and 50% Northern HWK. The sheets were formed fully stratified with all the HWK on the yankee dryer side. The sheets were creped from the yankee using a 15 degree beveled creping blade. The yankee coating was a mixture of Houghton 8203 adhesive and Houghton 565 mineral release oil. The sheets were calendered through a single nip to a target caliper of 30 mils/8 sheets. The target basis weight was 8.5 lbs/3000 sq ft; the target reel moisture was 4%. Refining of the SWK was used to control the strength of the sheets. The sheets made using foam forming technology were made with a target foam air content of 62%.

The resulting tissue base sheets had the following analysis and physical properties:

| Method of Forming | Basis Weight | Caliper | MD Tensile | CD Tensile | % MD Stretch | % CD Stretch | Kaj. Form. |
|---|---|---|---|---|---|---|---|
| Water | 8.8 | 28.6 | 509 | 300 | 17.0 | 3.8 | 82.3 |
| | 8.8 | 30.8 | 509 | 318 | 18.0 | 4.0 | 80.3 |
| Foam | 8.7 | 32.4 | 523 | 311 | 24.0 | 4.2 | 87.7 |
| | 8.5 | 31.8 | 499 | 303 | 22.0 | 4.0 | 89.1 |

Figure 5:
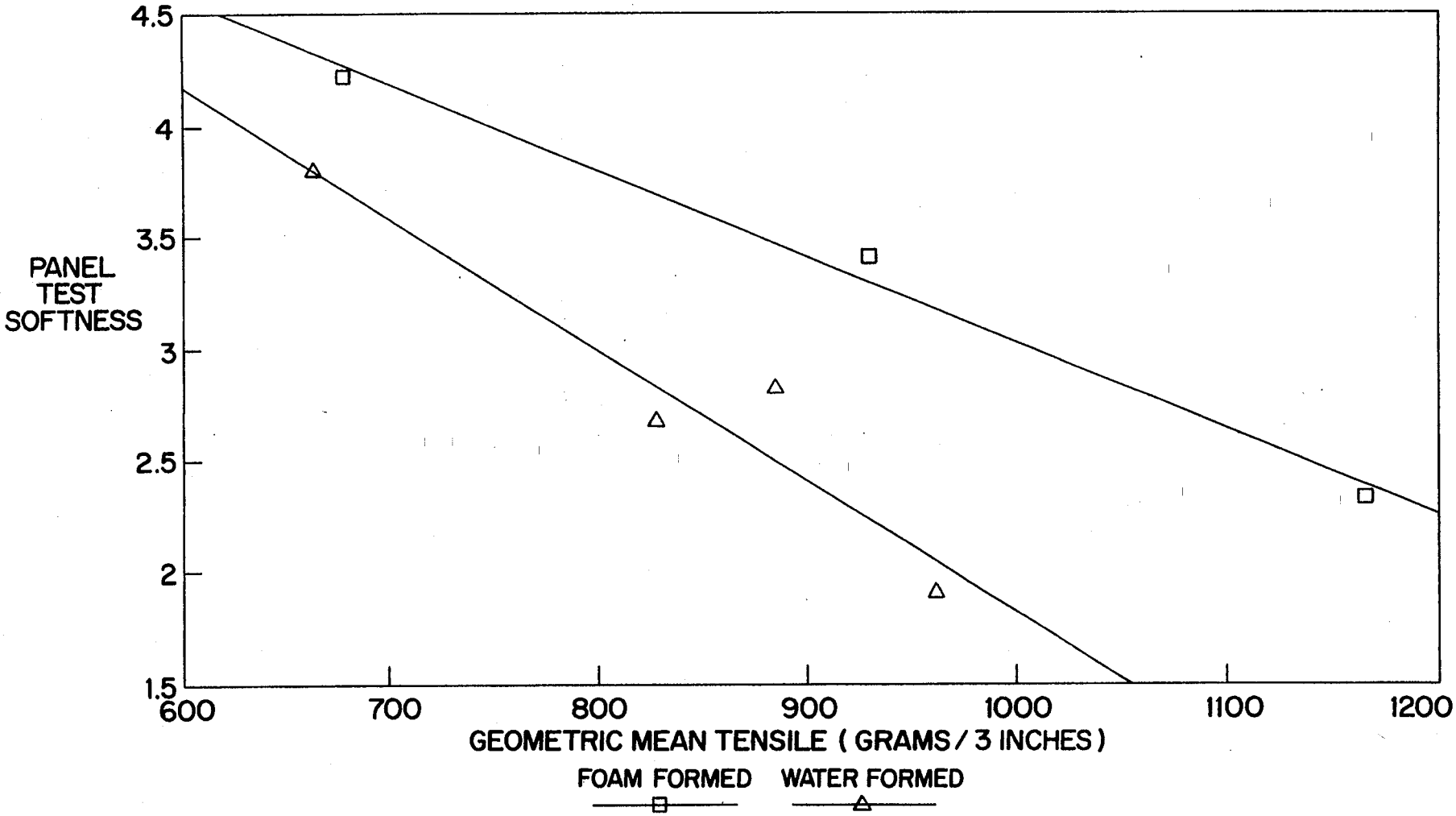
FIG. 5 illustrates the dramatic difference between the strength and perceived softness relationship of tissue of the present invention and comparable conventional water formed tissue.

Multi-ply products were formed from these tissues by embossing two plies together under the following conditions:

The products used for the panel test softness comparison of FIG. 5 were embossed on the 24" emboss line. The emboss speed was 150–200 fpm and the emboss penetration depth was set at 0.065 inches. The embossing was done using the nested emboss mode. The products were wound onto cores to make rolls of approximately 4.5 inches in diameter, each roll consisting of 300 sheets, 4.5 inches in length. The rolls wound on the emboss line were then cut into individual tissue rolls. The rolls were 4.5 inches in width.

The embossing pattern illustrated in FIG. 6 was used at a die depth of 0.065 inches to produce a sheet characterized by the following:

| Method of Forming | Basis Weight | MD Caliper | CD Tensile | % MD Tensile | % CD Stretch | Stretch |
|---|---|---|---|---|---|---|
| Water | 16.8 | 70.2 | 946 | 464 | 11.2 | 4.8 |
| Foam | 16.6 | 71.2 | 926 | 496 | 14.6 | 4.9 |

Example 3

The sheets were made on the high-speed pilot machine (HSPM). The machine was in a crescent former configuration. The forming fabric was an Asten 94 M, the felt an Albany Superfine Triovent. The machine (yankee) speed was 3000 fpm and the % crepe was targeted at 20%. The sheets consisted of 50% northern SWK and 50% northern HWK. The sheets were formed fully stratified with all the HWK on the yankee dryer side. The sheets were creped from the yankee using a 15 degree beveled creping blade. The yankee coating was a mixture of Houghton 8203 adhesive and Houghton 565 mineral release oil. The sheets were calendered through a single nip to a target caliper of 30 mils/8 sheets. The target basis weight was 8.5 lbs/3000 sq ft; the target reel moisture was 4%. Refining of the SWK was used to control the strength of the sheets. The sheets made using foam forming technology were made with a target foam air content of 62%.

The resulting tissue base sheets had the following analysis and physical properties:

| Method of Forming | Basis Weight | Caliper | MD Tensile | CD Tensile | % MD Stretch | % CD Stretch | Kaj. Form. |
|---|---|---|---|---|---|---|---|
| Water | 8.7 | 28.4 | 576 | 354 | 17.0 | 3.8 | 78.9 |
| | 8.5 | 28.6 | 535 | 334 | 16.0 | 4.0 | 80.3 |
| Water | 8.7 | 28.2 | 646 | 426 | 18.0 | 3.9 | 84.0 |
| | 8.7 | 29.0 | 615 | 390 | 17.0 | 3.7 | 82.2 |
| Foam | 8.4 | 30.6 | 701 | 423 | 25.0 | 3.7 | 92.0 |
| | 8.7 | 29.2 | 729 | 468 | 26.0 | 3.6 | 91.6 |

Multi-ply products were formed from these tissues by embossing two sheets together lander the following conditions:

The products used for the panel test softness comparison of FIG. 5 were embossed on the (24") emboss line. The emboss speed was 150–200 fpm and the emboss penetration depth was set at 0.065 inches. The embossing was done using the nested emboss mode. The products were wound onto cores to make rolls of approximately 4.5 inches in diameter, each roll consisting of 300 sheets, 4.5 inches in length. The rolls wound on the emboss line were then cut into individual tissue rolls. The rolls were 4.5 inches in width.

The embossing pattern illustrated in FIG. 6 was used at a die depth of 0.065 inch to produce a sheet characterized by:

| Method of Forming | Basis Weight | Caliper | MD Tensile | CD Tensile | % MD Stretch | % CD Stretch |
|---|---|---|---|---|---|---|
| Water | 16.5 | 69.0 | 1194 | 574 | 11.5 | 4.8 |
| Water | 17.1 | 71.0 | 1260 | 622 | 12.3 | 4.7 |
| Foam | 16.2 | 70.5 | 1232 | 701 | 15.0 | 4.7 |

Example 4

The multi-ply products were made on the high-speed pilot machine (HSPM). The machine was in a crescent former configuration. The forming fabric was an Asten 94 M, the felt an Albany Superfine Triovent. The machine (yankee) speed was 3000 fpm and the % crepe was targeted at 20%. The sheets consisted of 50% northern SWK and 50% northern HWK. The sheets were formed fully stratified with all the HWK on the yankee dryer side. The sheets were creped from the yankee using a 15 degree beveled creping blade. The yankee coating was a mixture of Houghton 8203 adhesive and Houghton 565 mineral release oil. The sheets were calendered through a single nip to a target caliper of 30 mils/8 sheets. The target basis weight was 8.5 lbs/3000 sq ft; the target reel moisture was 4%. Refining of the SWK was used to control the strength of the sheets. The sheets made using foam forming technology were made with a target foam air content of 62%.

The resulting tissue base sheets had the following analysis and physical properties:

| Method of Forming | Basis Weight | Caliper | MD Tensile | CD Tensile | % MD Stretch | % CD Stretch | Kaj. Form. |
|---|---|---|---|---|---|---|---|
| Water | 8.7 | 29.0 | 752 | 415 | 19.0 | 3.6 | 79.5 |
| | 8.7 | 29.4 | 730 | 424 | 18.0 | 3.7 | 80.2 |
| Foam | 8.6 | 29.0 | 883 | 521 | 26.0 | 3.6 | 89.9 |
| | 8.3 | 28.6 | 727 | 484 | 22.0 | 4.0 | 90.8 |

Multi-ply products were formed from these tissues by embossing two sheets together under the following conditions:

The products used for the panel test softness comparison of FIG. 5 were embossed on the 24" emboss line. The emboss speed was 150–200 fpm and the emboss penetration depth was set at 0.065 inches. The embossing was done using the nested emboss mode. The sheets were wound onto cores to make rolls of approximately 4.5 inches in diameter, each roll consisting of 300 sheets, 4.5 inches in length. The rolls wound on the emboss line were then cut into individual tissue rolls. The rolls were 4.5 inches in width.

The embossing pattern illustrated in FIG. 6 was used at a die depth of 0.065 inches to produce a sheet characterized by:

| Method of Forming | Basis Weight | Caliper | MD Tensile | CD Tensile | % MD Stretch | % CD Stretch |
|---|---|---|---|---|---|---|
| Water | 17.1 | 69.3 | 1382 | 668 | 12.8 | 4.2 |
| Foam | 16.6 | 69.7 | 1520 | 894 | 16.6 | 4.4 |

The tissues from examples 2, 3, and 4 were evaluated for softness by a sensory panel. The methodology used was the paired comparison with these results being translated to scale values using the Thurstone algorithm. The results of these panel tests are shown in FIG. 5 from which it can be seen that, for tissues at approximately equal strength, the foam formed tissues were judged to be significantly softer than were the water formed tissues. Alternatively, for tissue having the same perceived softness, those made by foam forming were stronger than those made using water forming.

Example 5

Tissue having improved attractiveness at equal softness was formed by the foam forming process on an experimental twin wire former ("TWF") and subsequently embossed using a nested steel-to-rubber configuration. Strength was controlled by addition of dry strength agent and refining. The resulting 2-ply tissue product had a basis weight of 16.4 lb/3000 sq ft and a total tensile of 1554. The embossing pattern was the pattern of FIG. 6 at a depth estimated to be 0.050 inch as described in FIG. 1 of U.S. Pat. No. 4,659,608.

| Operating condition | Water Forming | Foam Forming |
|---|---|---|
| Refining: Sprout Waldron | 56.8 | 58.1 |
| Flow, gpm | | |
| % Flow recycled thru refiner | 27% | 50% |
| Consistency | 3.29% | 3.19% |
| Canadian Std Freeness (CSF) | 500 | 400 |
| HP (day/T) | 4.31 | 4.77 |
| Headbox Slice Opening, inches | 0.49 | 0.39 |
| Machine Speed (Yankee), fpm | 3200 | 3200 |
| Air Content | | 58–60% |
| Pressure Roll Loading, pli | 475 | 475 |
| Wet-End Hood Temp, °F. | 800–780 | 550 |
| Dry-End Hood Temp, °F. | 810–710 | 450 |
| Yankee Surface Temp, °F. | 200–210 | 190–185 |
| Yankee Release, lb/T | 0.6 | 2.7 |
| Calender Crepe, % | 18 | 18 |
| Reel Crepe, % | 16.5 | 16.5 |
| Calender Loading, pli | 5 | 5 |

When compared with an equal strength water formed tissue embossed sheet at an estimated emboss depth of 0.045, consumer panels perceived a significant improvement in attractiveness in a paired blind consumer preference. Conventional experience with water formed sheets would have predicted the improved attractiveness due to the deeper embossing, however the improvement would have been at the expense of softness. In this example, however, we found that the foam formed sheet when embossed to a high depth resulted in a new combination of softness and attractiveness not previously experienced with water formed sheets.

| (1) Water-Formed vs. (2) Foam Forming (3) No Preference | (1) | (2) | (3) |
|---|---|---|---|
| Overall Preference | 42 | 41 | 17 |
| Degree of Preference | | | |
| Very Much More | 10 | 6 | |
| Somewhat More | 9 | 12 | |
| Slightly More | 23 | 23 | |
| Base: | 100 | 100 | |
| For Softness | 40 | 51 | 9 |
| For Strength | 51* | 30 | 19 |
| For Absorbency | 42 | 44 | 14 |
| Less Rough/Scratchy | 39 | 47 | 14 |
| Attractiveness | 15 | 39* | 46 |
| Tears Off of Roll | 27 | 39 | 34 |

| Product | Exp Foam Formed Tissue | Exp Water Formed Tissue |
|---|---|---|
| PRODUCT IDENTIFICATION | | |
| Plies | 2 | 2 |
| Process Type | water | foam |
| Emboss | Tulip | Tulip |
| Sheet Width | 4.5 | 4.5 |
| Sheet Count | 300 | 300 |
| Sq. Ft./Roll | 42.19 | 42.19 |
| Form | Roll | Roll |
| Color | White | White |
| Furnish | 67% Douglas FIR-SWK 33% Grand Prairie-HWK | 67% Douglas FIR-SWK 33% Grand Prairie-HWK |
| PHYSICAL PROPERTIES | | |
| Basis Weight | | |
| (lb/Ream) | 19.0 | 16.4 |
| (Grams/Roll) | 121.5 | 104.6 |
| (Grams/5 Sheets) | 2.0 | 1.7 |
| Caliper | 70.0 | 70.0 |
| Tensile | | |
| MD | 1118.0 | 1110.0 |
| CD | 442.0 | 444.0 |
| Total Tensile | 1560.0 | 1554.0 |
| Ratio | 2.5 | 2.5 |
| GM | 703.0 | 702.0 |
| % Stretch | | |
| MD | 7.0 | 8.3 |
| CD | 6.6 | 6.6 |

*Significantly Different at the 95% Level of Confidence

Example 6

The tissue of Example 5 was formed by the foam forming process on an experimental TWF and subsequently embossed using a nested steel-to-rubber configuration.

The resulting 2-ply tissue product had a basis weight of 16.4 lb/ream and a total tensile of 1554. The embossing pattern was the pattern of FIG. 6 at the same depth. The purpose of the original experiment was to obtain consumer reaction to identical products in all physical measures with the one exception of basis weight.

Example 5 describes consumer reaction to the improved attractiveness; however, this test identified another unexpected result. The consumer perceived a significant strength difference for products which had substantially identical physical measures (1554 vs. 1560). Thus, even though the consumer had indicated that the softness of the two identical physical strength products had identical softness, an expected result, the two products were not perceived as having equal strengths. This was not expected. In fact, the foam formed product was perceived as being the weaker of the two.

This was not a desirable result since the traditional experience of using measured physical strength to correlate between perceived strength and softness had been complicated through the interaction of the foam formed sheet weight and embossing.

Example 7

Tissues were formed as in Example 5 by the foam forming process on an experimental twin wire former ("TWF") and subsequently embossed using a nested steel-to-rubber configuration. The resulting 2-ply foam formed tissue product was embossed using the embossing pattern of FIG. 6, at a depth of 0.070 inch. In this example, we compare two roughly equivalent strength products (1893 and 1714 g/3-inch), the water formed being slightly stronger and made using a lower depth of emboss, 0.062 inch.

| | (1) Water Formed vs. (2) Foam Formed (3) No Preference | | |
|---|---|---|---|
| | (1) | (2) | (3) |
| Overall Preference | 36 | 52 | 12 |
| Degree of Preference | | | |
| Very Much More | 7 | 12 | |
| Somewhat More | 6 | 15 | |
| Slightly More | 23 | 25 | |
| Base: | 100 | 100 | |
| For Softness | 29 | 61* | 10 |
| For Strength | 51* | 30 | 19 |
| For Absorbency | 38 | 47 | 15 |
| Less Rough/Scratchy | 31 | 55* | 14 |
| Attractiveness | 18 | 31 | 51 |
| Tears off Roll | 31 | 37 | 32 |

| Product | Exp Foam Formed Tissue | Exp Water Formed Tissue |
|---|---|---|
| PRODUCT IDENTIFICATION | | |
| Plies | 2 | 2 |
| Process Type | water | foam |
| Emboss | Tulip | Tulip |
| Sheet Width | 4.5 | 4.5 |
| Sheet Count | 300 | 300 |
| Sq Ft/Roll | 42.19 | 42.19 |
| Form | Roll | Roll |
| Color | White | White |
| Furnish | 67% Doug Fir-SWK 33% Grand Prairie-HWK | 67% Doug Fir-SWK 33% Grand Prairie-HWK |
| PHYSICAL PROPERTIES | | |
| Basis Weight | | |
| (lb/Ream) | 19.7 | 16.4 |
| (Grams/Roll) | 125.4 | 104.9 |
| (Grams/5 Sheets) | 2.1 | 1.7 |
| Caliper | 68.6 | 67.0 |
| Tensile | | |
| MD | 1353.4 | 1214.0 |
| CD | 539.4 | 500.4 |
| Total Tensile | 1892.8 | 1714.4 |
| Ratio | 2.5 | 2.4 |
| GM | 853.8 | 778.8 |
| % Stretch | | |
| MD | 10.4 | 10.0 |
| CD | 7.1 | 7.8 |

*Significantly Different at the 95% Level of Confidence

Even though these products had roughly equivalent measured physical strengths, the consumers perceived the embossed foam formed product to be both softer and weaker than the water formed control which is consistent with the results of Examples 5 and 6. Compared to Examples 5 and 6, we found this gain in softness was at the expense of the attractiveness and offset from the physical strength experience with the embossed water formed product experience. Normally, consumers are expected to percieve two products varying in strength by only 10% as equally strong.

Example 8

To obtain data on the degree to which calendering impacts the softness of water formed and foam formed tissues, several trials were run of pairs of 2-ply foam formed and water formed sheets of equal measured strength, both before and after calendering.

The results show that calendering both water formed and foam formed tissues significantly increases tissue softness for both water formed and foam formed tissues.

Methodology: The products were evaluated by sensory panel using paired comparison methodology in a full factorial array. The scale values were determined using the Thurstone algorithm. The lowest score was set to a value of 0, with all other values being set relative to it.

| OVERALL SOFTNESS | | |
|---|---|---|
| Formation | Degree of Finish | Scale Value |
| Water Formed | Uncalendered | 0.00 |
| Foam Formed | Uncalendered | 1.74 |
| Water Formed | Calendered | 1.79 |
| Foam Formed | Calendered | 2.51 |

*Differences in scale values of 0.25 or greater indicate a significant difference at the 95% level of confidence Detailed Findings: The water formed uncalendered tissue was judged as being significantly* less soft than all other products tested. The water formed calendered and foam formed uncalendered products were not found to be significantly* different from one another, while the foam formed calendered tissue was significantly* softer than all other products tested.

*Significant at a 95% or greater confidence level.

The difference in softness scale values between the two water formed products was greater ($\Delta=1.79$) than the difference in softness between the two foam formed products ($\Delta=0.77$).

Example 9

The tissues of this example were formed by the foam forming process on an experimental paper machine and subsequently embossed using a point-to-point embossing configuration. The resulting tissue product had a basis weight of 44.8 g/m$^2$ and a total tensile strength (cross direction and machine direction) of 435 cN/15 mm (centi-newtons/15 mm). The embossing resulted in 28% strength reduction from the initial 3-ply strength. In this example, we compare equal roll diameter and sheet count products. This experiment was to obtain consumer reaction to identical appearing roll products, one made using foam forming and a lower basis weight than the control water formed product. The results indicated that one-half of the normal users of one and two ply products did not identify a strength perception difference despite the significant difference in the physical strength (26% lower for the foam formed). Eighty-five percent of these customers found the embossed foam formed products gave entire satisfaction for both softness and strength.

| | Foam Formed | Water Formed |
|---|---|---|
| Diameter (cm) | 13.1 | 12.9 |
| Sheets | 170 | 170 |
| Roll Compression (%) | 27 | 29 |
| Weight (g/m$^2$) | 44.8 | 47.3 |
| Strength Total Tensile cN/15 mm | 435 | 575 |

Example 10

The tissues of this example were formed by the foam forming process on an experimental paper machine and subsequently embossed using a point-to-point configuration. The resulting 3-ply tissue products had a basis weight of 40.1 g/m$^2$ and a total tensile of 465. The embossing resulted in a 19% strength reduction from the initial 3-ply strength. In this example we compare equal roll diameter and sheet count products. This experiment was to obtain consumer reaction to identical appearing roll products, one made using foam forming and a lower basis weight than the control water formed product. As expected the attractiveness of the two equal emboss depth products were perceived as being equal. However, this test resulted in an unexpected result. The 15.2% lower weight foam formed product resulted in a product perceived as having both improved roll firmness (38% decrease in roll compression over the water formed control) and a significant softness improvement. This is consistent with the results of Example 5 for nested embossing.

| | Foam Formed | Water Formed |
|---|---|---|
| Diameter (cm) | 13.0 | 12.9 |
| Sheets | 170 | 170 |
| Roll Compression | 18 | 29 |
| Weight (g/m$^2$) | 40.1 | 47.3 |
| Strength Total Tensile cN/15 mm | 465 | 575 |

Example 11

The tissues of this example were formed by the foam forming process on an experimental paper machine and subsequently embossed using a point-to-point configuration. The resulting 2-ply tissue products had a basis weight of 34.8 g/m$^2$ and a total tensile of 435. In this example we compare equal roll diameter and sheet count products. This experiment was to obtain consumer reaction to identical appearing and physical property roll products, one made using foam forming and a control water formed product (35.6 g/m$^2$, total tensile of 445 cN/15 mm). Based upon home use testing, 68% of the customers preferred the foam formed product while only 22.7% preferred the water formed product. The main reason given for the overall preference for the embossed foam formed product were softer and pleasant touch. As expected there was even a perception that the foam formed product was thicker due to the equal weight and better formation.

| | Foam Formed | Water Formed |
|---|---|---|
| Diameter (cm) | 10.2 | 9.9 |
| Sheets | 198 | 198 |
| Weight (g/m$^2$) | 34.8 | 35.6 |
| Strength Total Tensile (cN/15 mm) | 435 | 445 |

Example 12

The tissues of this example were formed by both the foam forming process and the water forming process on an experimental crescent former and subsequently embossed using a nested steel-to-rubber configuration. The resulting 2-ply tissue products had basis weights of approximately 17 lb/3000 sq ft ream and total tensiles of 2414 g/3-inch for the foam formed and 2050 g/3-inch for the water formed. The embossing used the pattern of FIG. 6 at a depth of 0.065 inches. The purpose of this experiment was to obtain consumer reaction to identical basis weight products having equal unembossed softness.

The embossed and unembossed foam and water formed tissues made from the same pairs of rolls were tested for softness using paired comparison tests. The physical properties for the tissues were:

| | lbs./ 3000 sq. ft. | Caliper mils | Total Tensile (g/3-inch) | % Stretch MD | % Stretch CD |
|---|---|---|---|---|---|
| Unembosssed | | | | | |
| Foam Formed | 16.8 | 52.8 | 2724 | 20 | 4 |
| Water Formed | 17.3 | 52.1 | 2307 | 16 | 4 |
| Embossed | | | | | |
| Foam Formed | 16.6 | 69.7 | 2414 | 17 | 4 |
| Water Formed | 17.1 | 69.3 | 2050 | 13 | 4 |

The results of the paired comparison test is shown:

| | |
|---|---|
| Unembossed | foam 31.6%; water 23.7%; no difference 44.7% |
| Embossed | foam 52.5%; water 22.5%; no difference 25.0%. |

The results show the relative percentage of the panelists who chose the indicated tissue as softer. The results for the unembossed tissues do not show a statistically significant difference in softness. The results for the embossed tissues show that there is a statistically significant difference in softness and that the foam formed-/embossed tissue was softer at a 95% confidence level.

The inherent softness/strength advantage of foam forming is represented by the 18.5% stronger unembossed foam formed sheet which gave equal softness perception at equal weight. The unexpected results of this test is represented by the improvement in softness as a direct result of the embossing. After embossing the foam formed sheet retained its strength advantage (17.7%) but was also perceived to have a significant softness advantage.

Throughout this Specification and the appended Claims, where a weight average fiber length is mentioned, unless explicitly stated to the contrary, such a percentage should be understood to mean a average weighted by the length of each individual fiber so as to properly account for the greater impact of longer fibers on the properties of the sheet formed and to properly discount the relatively lesser significance of relatively shorter fibers, i.e. the sum of the product of the cube of the length and number of fibers of that length divided by the sum of the products of the squares of the lengths by the number of fibers of that length.

As mentioned previously, since determination of softness can be considered to be subjective, through out this Specification and the appended Claims, unless explicitly stated to the contrary, one tissue is defined to possess "perceptibly improved softness" as compared to another if any of the following criteria are satisfied:

1. When subjected to a properly administered Sensory Panel consisting of unbiased evaluations of softness by a large number of consumers who handle each pair of tissue and report which they evaluate as the softest, the one tissue is rated as significantly softer than the other by a sufficient fraction of the participants to be considered statistically significant at the 95% confidence level according to the chi-squared criteria; or
2. If the one tissue has both: significantly lower stiffness modulus; and significantly lower measured roughness as determined either by measurement of the root mean square roughness or the geometric mean deviation in the coefficient of friction; or
3. If the tissues have essentially equivalent stiffness modulus but the one has a significantly lower measured roughness; or
4. If the tissues have essentially equivalent measured roughness but the one has a significantly lower stiffness modulus.

For the purposes of this Specification and Claims, one of the following differences in either stiffness modulus or measured roughness shall be considered significant:

a difference of 0.0015 in geometric mean deviation in coefficient of friction;

a difference of 3 grams @ 50 gr/inch in stiffness modulus; or a difference of 0.005 mm in root mean square surface roughness;

unless the one tissue possesses both lower stiffness modulus and measured roughness, in which case a difference of 0.0010 in geometric mean deviation in coefficient of friction, a difference of 2 grams in the stiffness modulus @ 50 g/in, or a difference of 0.003 mm in root mean square roughness shall be considered significant.

As our invention, we claim:

1. A multi-ply tissue product comprising at least two foam-formed plies incorporating at least about 100 ppm of forming-loop-incorporated surfactant, each said ply comprising:

from at least about 50% by weight to about 80% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 m of fiber length (mg/100 m);

from at least about 20% by weight to about 50% by weight of relatively long strength-enhancing cellulosic fiber chosen from the group consisting of chemically pulped softwood fiber and chemi-thermo-mechanically pulped softwood fiber and mixtures thereof: said strength-enhancing cellulosic fiber having a weight average fiber length of about 2 to about 4 mm, a coarseness of about 14 to about 28 mg/100 m;

optionally, up to about 30% by weight of bulk-enhancing fibers having a three-dimensional anfractuous character;

said plies being embossed together to an emboss depth of at least about 0.020 inch, the percent loss in total dry breaking tensile strength upon embossing of the tissue being no more than about 80% of the percent loss in total dry breaking tensile strength upon embossing plies of a comparable conventional water formed tissue having the same structure, fiber composition, basis weight and unembossed total dry breaking tensile strength to the same emboss depth using the same embossing pattern, each of said water formed plies being of the same fiber composition, basis weight, percent crepe and unembossed total dry breaking tensile strength as the corresponding ply of said multi-ply tissue product;

each said ply having a basis weight of from about 4 to about 20 pound per 3,000 sq. ft. ream; an 8 ply caliper to 3000 sq. ft. basis weight ratio exceeding about 3.7 mils/pound of basis weight, calculated based on the thickness of 8 plies in mils divided by the basis weight of a single ply of a 3,000 sq. ft. ream in pounds.

2. The multi-ply tissue product of claim 1, wherein the surface root mean square roughness of each of said foam formed plies of the tissue is no more than about 0.018 mm.

3. The multi-ply tissue product of claim 1, wherein the surface root mean square roughness of each of said foam formed plies of the tissue is no more than about 0.020 mm and wherein the Kajaani formation Index of the foam formed ply is at least about 75.

4. The multi-ply tissue product of claim 1, wherein the plies are embossed together with a nested emboss having a depth of at least about 0.030 in.

5. The multi-ply tissue product of claim 1, wherein of said hardwood fibers in said foam formed plies, at least about 50% by weight thereof are eucalyptus fibers.

6. The multi-ply tissue product of claim 1, wherein the percentage of hardwood fibers in each of said foam formed plies is at least about 75% by weight and wherein the surface root mean square roughness of the unembossed area of each of said foam formed plies of the tissue is no more than about 0.018 mm and wherein the plies are embossed together with a nested emboss having a depth of at least about 0.030 in.

7. The multi-ply tissue product of claim 1, wherein the percentage of hardwood fibers in each of said foam formed plies is at least about 60% by weight.

8. The multi-ply tissue product of claim 7, wherein each of said foam formed plies of tissue has a Kajaani Formation Index of at least about 80, a total dry breaking tensile strength (machine direction tensile strength plus cross direction tensile strength) of at least about 50 grams per pound per 3000 sq. ft. ream per 3 inch width, a stiffness modulus of no more than about 13 grams @ 50 g/in, and wherein the surface root mean square roughness of the unembossed area of each of said foam formed plies is no more than about 0.018 mm.

9. The multi-ply tissue product of claim 8, wherein each of said foam formed plies has a total dry breaking tensile strength (machine direction tensile strength plus cross direction tensile strength) of at least about 75 grams per pound per 3000 sq. ft. ream per 3-inch width, a stiffness modulus of no more than about 16 grams @

50 g/in, and a hardwood content of at least about 75% by weight.

10. The multi-ply tissue product of claim 9, wherein the geometric mean deviation in the coefficient of friction of the surface of each of said foam formed plies is no more than about 0.013 and wherein the stiffness modulus of said multi-ply tissue is no more than about 16 grams @ 50 g/in.

11. The multi-ply tissue product of claim 10, wherein each of said foam formed plies is a calendered ply having a geometric mean deviation in the coefficient of friction of the surface of said foam formed ply of no more than about 0.009 and wherein the stiffness modulus is no more than about 25 grams @ 50 g/in.

12. An embossed, biological membrane contact compatible, multi-ply tissue product comprising at least one foam-formed ply of tissue incorporating at least about 100 ppm of forming-loop-incorporated surfactant and having at least two strata defined therein, at least one exterior stratum of said foam-formed ply comprising:

from at least about 60% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

no more than about 40% by weight of relatively long, strength-enhancing cellulosic fiber chosen from the group consisting of chemically pulped softwood fiber and chemi-thermo-mechanically pulped softwood fiber and mixtures; said strength-enhancing cellulosic fiber having a weight average fiber length of about 2 to about 4 mm, a coarseness of about 14 to about 28 mg/100 m;

at least one other stratum of said foam-formed ply comprising:

no more than about 35% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

at least about 60% by weight of relatively long strength-enhancing cellulosic fiber chosen from the group consisting of chemically pulped softwood fiber and chemi-thermo-mechanically pulped softwood fiber and mixtures thereof; said strength-enhancing cellulosic fiber having a weight average fiber length of about 2 to about 4 mm, and a coarseness of about 14 to about 28 mg/100 m;

optionally, up to about 30% by weight of bulk-enhancing fibers having a three-dimensional anfractuous character;

said foam formed ply of tissue having: a total dry breaking tensile strength (machine direction tensile strength plus cross direction tensile strength) of at least about 50 grams per pound per 3000 sq. ft. ream per 3-inch width, said embossed tissue being embossed with a nested pattern to a depth of at least about 0.020 inch over at least about 10% of its area and exhibiting a percent loss in total dry breaking tensile strength upon embossing of no more than about 80% of the percent loss in total dry breaking tensile strength experienced upon embossing a like number of plies of a comparable conventional water formed tissue having the same structure, overall fiber composition, basis weight and unembossed total dry breaking tensile strength to the same depth of emboss using the same embossing pattern, each of said water formed plies being of the same fiber composition, basis weight, percent crepe and unembossed total dry breaking tensile strength as the corresponding ply of said embossed tissue comprising at least one foam formed ply;

said ply having a basis weight of from about 4 to about 20 pounds per 3,000 sq. ft. ream; an 8 ply caliper to 3000 sq. ft. basis weight ratio exceeding about 3.7 mils/pound of basis weight, calculated based on the thickness of 8 plies in mils divided by the basis weight of a single ply of a 3,000 sq. ft. ream in pounds.

13. The embossed tissue product of claim 12, being further characterized by a stiffness modulus no greater than about 25 grams @ 50 g/in; the root mean square roughness of at least one surface of said foam formed ply being no more than about 0.018 mm; and the geometric mean deviation in the coefficient of friction of the exterior surface of said foam formed ply being no more than about 0.009.

14. The embossed tissue product of claim 12, being further characterized by a stiffness modulus no greater than about 16 grams @ 50 g/in; the root mean square roughness of at least one surface of said foam formed ply being no more than about 0.020 mm; and the geometric mean deviation in the coefficient of friction of the exterior surface of said foam formed ply being no more than about 0.013.

15. The embossed tissue product of claim 12, wherein the surface of said exterior stratum of said foam formed ply has a root mean square roughness of no more than about 0.020 mm.

16. The embossed tissue product of claim 12, wherein the surface root mean square roughness of said exterior stratum of said foam formed ply of the tissue is no more than about 0.018 mm and wherein the Kajaani Formation Index of said foam formed ply is at least about 80.

17. The embossed tissue product of claim 12, wherein the plies of said multi-ply tissue product are embossed together with a nested emboss having a depth of at least about 0.030 in.

18. The embossed tissue product of claim 12, said hardwood fibers in said foam formed ply, at least about 50% by weight thereof are eucalyptus fibers.

19. The embossed tissue product of claim 12, wherein the percentage of hardwood fibers in said exterior stratum of said foam formed ply is at least about 75% by weight by weight and wherein the surface root mean square roughness of the exterior stratum of said foam formed ply is no more than about 0.018 mm and wherein the plies are embossed together with a nested emboss having a depth of at least about 0.030 in.

20. The embossed tissue product of claim 12, wherein the percentage of hardwood fibers in the exterior stratum of said foam formed ply is at least about 75% by weight.

21. The embossed tissue product of claim 12, wherein said foam formed ply of tissue has a Kajaani Formation Index of at least about 80, a total dry breaking tensile strength (machine direction tensile strength plus cross direction tensile strength) of at least about 50 grams per pound per 3000 sq. ft. ream per 3-inch width, a stiffness modulus of no more than about 13 grams @ 50 g/in, and wherein the root mean square roughness of the exterior surface of said exterior stratum of the foam formed ply of the tissue is no more than about 0.018 mm.

22. The embossed tissue product of claim 21, wherein said foam formed ply has a total dry breaking tensile strength (machine direction tensile strength plus cross direction tensile strength) of at least about 75 grams per pound per 3000 sq. ft. ream per 3 inch width, a stiffness modulus of no more than about 16 grams @ 50 g/in, and a hardwood content of at least about 75% by weight.

23. The embossed tissue product of claim 22, wherein the geometric mean deviation in the coefficient of friction of the surface of said exterior stratum of said foam formed ply is no more than about 0.013 and wherein the stiffness modulus of said foam formed ply is no more than about 16 grams @ 50 g/in.

24. The embossed tissue product of claim 22, wherein said foam formed ply is a calendered ply having a geometric mean deviation in the coefficient of friction of the surface of said exterior stratum of said foam formed ply of no more than about 0.009 and wherein the stiffness modulus of said foam formed ply is no more than about 25 grams @ 50 g/in.

25. A multi-ply tissue product comprising at least two foam formed plies incorporating at least about 100 ppm of forming-loop-incorporated surfactant, each said ply comprising:

from at least about 50% by weight to about 80% by weight of relatively short, high softness cellulosic fiber formed by chemical pulping of hardwood, said fibers having a weight average fiber length of between about 0.5 to about 2.2 mm, a coarseness of about 7 to about 14 mg of fiber per 100 m of fiber length (mg/100 m);

from at least about 20% by weight to about 50% by weight of relatively long strength-enhancing cellulosic fiber chosen from the group consisting of chemically pulped softwood fiber and chemi-thermo-mechanically pulped softwood fiber and mixtures thereof, said strength-enhancing cellulosic fiber having a weight average fiber length of about 2 to about 4 mm, a coarseness of about 14 to about 28 mg/100 m;

optionally, up to about 30% by weight of bulk-enhancing fibers having a three-dimensional anfractuous character;

said piles being nested embossed to an emboss depth of at least about 0.020 inch over at least about 10% of its area, the tissue product being capable one retaining at least about 70% of the total dry breaking tensile strength of the unembossed plies upon nested embossing to a depth of no more than about 0.060 in. over 16% of its area;

said tissue product exhibiting a percent loss in total dry breaking tensile strength upon embossing of no more than about 80% of the percent loss in total dry breaking tensile strength experienced upon embossing plies of a comparable conventional water formed tissue having the same structure, overall fiber composition, basis weight and unembossed total dry breaking tensile strength to the same depth of emboss using the same embossing pattern, each of said water formed plies being of the same fiber composition, basis weight, percent crepe and unembossed total dry breaking tensile strength as the corresponding ply of the foam formed tissue; and each said ply having a basis weight of from about 4 to about 20 pounds per 3,000 sq. ft. ream; an 8 ply caliper to 3000 sq. ft. basis weight ratio exceeding about 3.7 mils/pound of basis weight, calculated based on the thickness of 8 plies in mils divided by the basis weight of a single ply of a 3,000 sq. ft. ream in pounds.

26. The multi-ply tissue product of claim 25, wherein the root mean square roughness of an exterior surface of one of the foam formed plies of the tissue is no more than about 0.020 mm.

27. The multi-ply tissue product of claim 25, wherein the root mean square roughness of an exterior surface of at least one of the foam formed plies of the tissue is no more than about 0.018 mm. and wherein the Kajaani Formation Index of said foam formed ply is at least about 80.

28. The multi-ply tissue product of claim 25, wherein the plies are embossed together with a nested emboss having a depth of at least about 0.030 in.

29. The multi-ply tissue product of claim 28, wherein said foam formed plies of tissue have a Kajaani Formation Index of at least about 80, a total dry breaking tensile strength (machine direction tensile strength plus cross direction tensile strength) of at least about 50 grams per pound per 3000 sq. ft. ream per 3 inch width a stiffness modulus of no more than about 13 grams @ 50 g/in, and wherein the root mean square roughness of an exterior surface of least one foam formed ply of the tissue is no more than about 0.018 mm.

30. The multi-ply tissue product of claim 29, wherein said at least one foam formed ply has a total dry breaking tensile strength (machine direction tensile strength plus cross direction tensile strength) of at least about 100 grams per pound per 3000 sq. ft. ream per 3 inch width, a stiffness modulus of no more than about 20 grams @ 50 g/in.

31. The multi-ply tissue product of claim 30, wherein the geometric mean deviation in the coefficient of friction of an exterior surface of said at least one foam formed ply is no more than about 0.013 and wherein the stiffness modulus thereof is no more than about 16 grams @ 50 g/in.

32. The multi-ply tissue product of claim 31, wherein said at least one foam formed ply is a calendered ply having a geometric mean deviation in the coefficient of friction of the exterior surface of said at least one foam formed ply of no more than about 0.009 and wherein the stiffness modulus thereof is no more than about 25 grams @ 50 g/in.

33. An embossed, foam-formed, biological membrane contact compatible, tissue product comprising at least three plies of tissue, at least one foam formed exterior ply of the product comprising:

at least about 100 ppm of forming-loop-incorporated surfactant, from at least about 60% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

no more than about 40% by weight of relatively long strength-enhancing cellulosic fiber chosen from the group consisting of chemically pulped softwood fiber and chemi-thermo-mechanically pulped softwood fiber and mixtures thereof; said strength-enhancing cellulosic fiber having a weight average fiber length of about 2 to about 4 mm., a coarseness of about 14 to about 28 mg/100 m;

said one ply of tissue having a total dry breaking tensile strength (machine direction tensile strength plus cross direction tensile strength) of at least about 50 grams per pound per 3000 sq. ft. ream per 3 inch width, a root mean square roughness of no more than about 0.020 mm; and at least one other ply comprising:

no more than about 25% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

at least about 60% by weight of relatively long strength-enhancing cellulosic fiber chosen from the group consisting of chemically pulped softwood fiber and chemi-thermo-mechanically pulped softwood fiber, and mixtures thereof; said strength-enhancing cellulosic fiber having a weight average fiber length of about 2 to about 4 mm, a coarseness of about 14 to about 28 mg/100 m;

optionally, up to about 30% by weight of bulk-enhancing fibers having a three dimensional anfractuous character;

said other ply of tissue having a total dry breaking tensile strength (machine direction tensile strength plus cross direction tensile strength) of at least about 100 grams per pound per 3000 sq. ft. ream per 3-inch width, said embossed tissue product being point-to-point embossed to a depth of at least about 0.030 inch over at least about 10% of its area and exhibiting a percent loss in total dry breaking tensile strength upon embossing of no more than about 80% of the percent loss in total dry breaking tensile strength experienced upon embossing plies of a comparable conventional water formed tissue having the same structure, overall fiber composition, basis weight and unembossed total dry breaking tensile strength to the same depth of emboss using the same embossing pattern, each of said water formed plies being of the same fiber composition, basis weight, percent crepe and unembossed total dry breaking tensile strength as the corresponding ply of the tissue product and being characterized by a perceptible softness no less than that of said comparable conventional water formed tissue, each said ply having a basis weight of from about 4 to about 20 pounds per 3,000 sq. ft. ream; an 8 ply caliper to 3000 sq. ft. basis weight ratio exceeding about 3.7 mils/pound of basis weight, calculated based on the thickness of 8 plies in mils divided by the basis weight of a single ply of a 3,000 sq. ft. ream in pounds.

34. The embossed tissue product of claim 33, wherein said one ply is further characterized: by a stiffness modulus no greater than about 25 grams @ 50 g/in.; the root mean square roughness of at least one surface of said one foam formed ply being no more than about 0.018 mm; and the geometric mean deviation in the coefficient of friction of the exterior surface of said one foam formed ply being no more than about 0.009.

35. The embossed tissue product of claim 33, wherein said one ply is further characterized by a stiffness modulus no greater than about 16 grams @ 50 g/in; the root mean square roughness of at least one surface of said one foam formed ply being no more than about 0.020 mm; and the geometric mean deviation in the coefficient of friction of the exterior surface of said one foam formed ply being no more than about 0.013.

36. The embossed tissue product of claim 33, wherein the exterior surface of said one foam formed ply of the tissue has a root mean square roughness of no more than about 0.020 mm.

37. The embossed tissue product of claim 33, wherein the surface root mean square roughness of said exterior surface of said one foam formed ply of the tissue is no more than about 0.018 mm and wherein the Kajaani Formation Index of said one foam formed ply is at least about 80.

38. The embossed tissue product of claim 33, wherein the plies are embossed together with a nested emboss having a depth of at least about 0.030 in.

39. The embossed tissue product of claim 33, wherein of said hardwood fibers in said foam formed ply, at least about 50% by weight thereof are eucalyptus fibers.

40. The embossed tissue product of claim 33, wherein the percentage of hardwood fibers in said exterior surface of said one foam formed ply is at least about 75% by weight and wherein the surface root mean square roughness of the exterior surface of said one foam formed ply of the tissue is no more than about 0.018 mm and wherein the plies are embossed together with a nested emboss having a depth of at least about 0.030 in.

41. The embossed tissue product of claim 33, wherein the percentage of hardwood fibers in said one foam formed ply is at least about 75% by weight.

42. The embossed tissue product of claim 33, wherein said one foam formed ply of tissue has a Kajaani Formation Index of at least about 80, a total dry breaking tensile strength (machine direction tensile strength plus cross direction tensile strength) of at least about 50 grams per pound per 3000 sq. ft. ream per 3 inch width, a stiffness modulus of no more than about 13 grams @ 50 g/in, and wherein the root mean square roughness of the exterior surface of said one foam formed ply of the tissue is no more than about 0.018 mm.

43. The embossed tissue product of claim 42, wherein said one foam formed ply has a total dry breaking tensile strength (machine direction tensile strength plus cross direction tensile strength) of at least about 75 grams per pound per 3000 sq. ft. ream per 3 inch width, a stiffness modulus of no more than about 16 grams @ 50 g/in, and a hardwood content of at least about 75% by weight.

44. The embossed tissue product of claim 43, wherein the geometric mean deviation in the coefficient of friction of the surface of said exterior one foam formed ply is no more than about 0.013 and wherein the stiffness modulus of said one foam formed ply is no more than about 16 grams @ 50 g/in.

45. The embossed tissue product of claim 44, wherein said one foam formed ply is a calendered ply having a geometric mean deviation in the coefficient of friction of the surface of said one foam formed ply of no more than about 0.009 and wherein the stiffness modulus of said one foam formed ply is no more than about 25 grams @ 50 g/in.

46. A tissue product comprising at least one foam formed embossed ply incorporating at least about 100 ppm of forming-loop-incorporated surfactant, said ply comprising:

from at least about 50% by weight to about 80% by weight of relatively short, high softness cellulosic fiber formed by chemical pulping of hardwood, said fibers having a weight average fiber length of between about 0.5 to about 2.2 mm, a coarseness of about 7 to about 14 mg of fiber per 100 m of fiber length (mg/100 m);

from at least about 20% by weight to about 50% by weight of relatively long strength-enhancing cellulosic fiber chosen from the group consisting of chemically pulped softwood fiber and chemi-thermo-mechanically pulped softwood fiber and mixtures thereof, said strength-enhancing cellulosic fiber having a weight average fiber length of about 2 to about 4 mm, a coarseness of about 14 to about 28 mg/100 m;

optionally, up to about 30% by weight of bulk-enhancing fibers having a three-dimensional anfractuous character;

said ply being an embossed ply having an exterior surface, the emboss being to an emboss depth of at least about 0.030 inch over at least about 5% of the area of said tissue, the total embossed area being at least about 10% of the area of said tissue, the tissue product being capable of retaining at least about 70% of the total dry breaking tensile strength of an unembossed ply upon point-to-point embossing to a depth of no more than about 0.050 in. over 16% of its area;

said tissue product exhibiting a percent loss in total dry breaking tensile strength upon embossing of no more than about 80% of the percent loss in total dry breaking tensile strength experienced upon embossing a ply of a comparable conventional water formed tissue having the same structure, overall fiber composition, basis weight and unembossed total dry breaking tensile strength to the same depth of emboss using the same embossing pattern, said water formed ply being of the same fiber composition, basis weight, percent crepe and unembossed total dry breaking tensile strength as the corresponding ply of the foam formed tissue; and said ply having a basis weight of from about 4 to about 20 pounds per 3,000 sq. ft. ream; an 8 ply caliper to 3000 sq. ft. basis weight ratio exceeding about 3.7 mils/pound of basis weight, calculated based on the thickness of 8 plies in mils divided by the basis weight of a single ply of a 3,000 sq. ft. ream in pounds.

47. The tissue product of claim 46, wherein the root mean square roughness of said exterior surface of said one foam formed ply of the tissue is no more than about 0.020 mm.

48. The tissue product of claim 46, wherein the root mean square roughness of said exterior surface of said foam formed ply of the tissue is no more than about 0.018 mm and wherein the Kajaani Formation Index of said foam formed ply is at least about 80.

49. An embossed, biological membrane contact compatible, tissue product comprising at least two foam-formed plies of tissue, each having at least two strata defined therein, at least one exterior stratum of each ply comprising:

at least about 100 ppm of forming-loop-incorporated surfactant;

from at least about 60% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

no more than about 40% by weight of relatively long, strength-enhancing cellulosic fiber chosen from the group consisting of chemically pulped softwood fiber and chemi-thermo-mechanically pulped softwood fiber and mixtures thereof; said strength-enhancing cellulosic fiber having a weight average fiber length of about 2 to about 4 mm, a coarseness of about 14 to about 28 mg/100 m;

at least one other stratum of each said foam-formed ply comprising:

no more than about 35% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

at least about 60% by weight of relatively long strength-enhancing cellulosic fiber chosen from the group consisting of chemically pulped softwood fiber and chemi-thermo-mechanically pulped softwood fiber and mixtures thereof; said strength-enhancing cellulosic fiber having a weight average fiber length of about 2 to about 4 mm, and a coarseness of about 14 to about 28 mg/100 m;

optionally, up to about 30% by weight of bulk-enhancing fibers having a three dimensional anfractuous character;

each said foam formed ply of tissue having: a total dry breaking tensile strength (machine direction tensile strength plus cross direction tensile strength) of at least about 50 grams per pound per 3000 sq. ft. ream per 3 inch width;

said embossed tissue being embossed with a pattern to a depth of at least about 0.020 inch over at least about 10% of its area and exhibiting a percent loss in total dry breaking tensile strength upon embossing of no more than about 80% of the percent loss in total dry breaking tensile strength experienced upon embossing a like number of plies of a comparable conventional water formed tissue having the same structure, overall fiber composition, basis weight and unembossed total dry breaking tensile strength to the same depth of emboss using the same embossing pattern, each of said water formed plies being of the same fiber composition, basis weight, percent crepe and unembossed total dry breaking tensile strength as the corresponding ply of said embossed tissue comprising at least one foam formed ply, each said ply having a basis weight of from about 4 to about 20 pounds per 3,000 sq. ft. ream; an 8 ply caliper to 3000 sq. ft. basis weight ratio exceeding about 3.7 mils/pound of basis weight, calculated based on the thickness of 8 plies in mils divided by the basis weight of a single ply of a 3,000 sq. ft. ream in pounds.

50. The embossed tissue product of claim 49, being further characterized by a stiffness modulus no greater than about 25 grams @ 50 g/in; the root mean square roughness of at least one exterior stratum of one of said foam formed plies being no more than about 0.018 mm; and the geometric mean deviation in the coefficient of friction of said one exterior stratum being no more than about 0.009.

51. The embossed tissue product of claim 49, being further characterized by a stiffness modulus no greater than about 16 grams @ 50 g/in; the root mean square roughness of at least one exterior stratum of one of said foam formed plies being no more than about 0.020 mm; and the geometric mean deviation in the coefficient of friction of the exterior surface of said one exterior stratum being no more than about 0.013.

52. The embossed tissue product of claim 49, wherein the surface of said exterior strata of each foam formed ply of the tissue has a root mean square roughness of no more than about 0.020 mm.

53. The embossed tissue product of claim 49, wherein the surface root mean square roughness of said exterior stratum of each foam formed ply of the tissue is no more than about 0.018 mm and wherein the Kajaani Formation Index of each foam formed ply is at least about 80.

54. The embossed tissue product of claim 49, wherein the plies are embossed together with a nested emboss having a depth of at least about 0.030 in.

55. The embossed tissue product of claim 49, wherein of said hardwood fibers in each said foam formed ply, at least about 50% by weight thereof are eucalyptus fibers.

56. The embossed tissue product of claim 49, wherein the percentage of hardwood fibers in said exterior strata of each said foam formed ply is at least about 75% by weight and wherein the surface root mean square roughness of the exterior strata of each foam formed ply of the tissue is no more than about 0.018 mm and wherein the plies are embossed together with a nested emboss having a depth of at least about 0.030 in.

57. The embossed tissue product of claim 49, wherein the percentage of hardwood fibers in the exterior strata of each said foam formed ply is at least about 75% by weight.

58. The embossed tissue product of claim 49, wherein each said foam formed ply of tissue has a Kajaani Formation Index of at least about 80, a total dry breaking tensile strength (machine direction tensile strength plus cross direction tensile strength) of at least about 50 grams per pound per 3000 sq. ft. ream per 3 inch width, a stiffness modulus of no more than about 13 grams @ 50 g/in, and wherein the root mean square roughness of the exterior surface of said exterior strata of each foam formed ply of the tissue is no more than about 0.018 mm.

59. The embossed tissue product of claim 58, wherein each said foam formed ply has a total dry breaking tensile strength (machine direction tensile strength plus cross direction tensile strength) of at least about 100 grams per pound per 3000 sq. ft. ream per 3 inch width, a stiffness modulus of no more than about 20 grams @ 50 g/in, and a hardwood content of at least about 75% by weight.

60. The embossed tissue product of claim 59, wherein the geometric mean deviation in the coefficient of friction of the surface of said exterior strata of each said foam formed ply is no more than about 0.013 and wherein the stiffness modulus of each said foam formed ply is no more than about 16 grams @ 50 g/in.

61. The embossed tissue product of claim 60, wherein each said foam formed ply is a calendered ply having a geometric mean deviation in the coefficient of friction of the surface of said exterior stratum of said foam formed ply of no more than about 0.009 and wherein the stiffness modulus of each said foam formed ply is no more than about 25 grams @ 50 g/in.

62. A multi-ply tissue product comprising at least two plies, at least one of which is a foam formed substantially homogeneous ply comprising:

at least about 100 ppm of forming-loop-incorporated surfactant;

from at least about 50% by weight to about 80% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

from at least about 20% by weight to about 50% by weight of relatively long strength-enhancing cellulosic fiber chosen from the group consisting of chemically pulped softwood fiber and chemi-thermo-mechanically pulped softwood fiber, and mixtures thereof; said strength-enhancing cellulosic fiber having a weight average fiber length of about 2 to about 4 mm, a coarseness of about 14 to about 28 mg/100 m;

optionally, up to about 30% by weight of bulk-enhancing fibers having a three-dimensional anfractuous character;

said plies being embossed together to an emboss depth of at least about 0.030 inch, the surface of said foam formed ply possessing a perceptible improvement in softness in relation to the softness of comparable conventional water formed tissue having the same structure, fiber composition, basis weight and unembossed total dry breaking tensile strength, embossed to the same emboss depth using the same embossing pattern, each of said water formed plies being of the same fiber composition, basis weight, percent crepe and unembossed total dry breaking tensile strength as the corresponding ply of said multi-ply tissue product, each said ply having a basis weight of from about 4 to about 20 pounds per 3,000 sq. ft. ream; an 8 ply caliper to 3000 sq. ft. basis weight ratio exceeding about 3.7 mils/pound of basis weight, calculated based on the thickness of 8 plies in mils divided by the basis weight of a single ply of a 3,000 sq. ft. ream in pounds.

63. An embossed, foam-formed, biological membrane contact compatible, tissue product comprising at least three plies of tissue, at least one substantially homogeneous foam formed exterior ply of the product comprising:

at least about 100 ppm of forming-loop-incorporated surfactant;

from at least about 60% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

no more than about 40% by weight of relatively long strength-enhancing cellulosic fiber chosen from the group consisting of chemically pulped softwood fiber and chemi-thermo-mechanically pulped softwood fiber, and mixtures thereof; said strength-enhancing cellulosic fiber having a weight average fiber length of about 2 to about 4 mm, a coarseness of about 14 to about 28 mg/100 m;

said one ply of tissue having a total dry breaking tensile strength (machine direction tensile strength plus cross direction tensile strength) of at least about 50 grams per pound per 3000 sq. ft. ream per 3 inch width, a root mean square roughness of no more than about 0.020 mm; and at least one other ply comprising:

no more than about 20% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

at least about 60% by weight of relatively long strength-enhancing cellulosic fiber chosen from the group consisting of chemically pulped softwood fiber and chemi-thermo-mechanically pulped softwood fiber, and mixtures thereof; said strength-enhancing cellulosic fiber having a weight average fiber length of about 2 to about 4 mm, a coarseness of about 14 to about 28 mg/100 m;

optionally, up to about 30% by weight of bulk-enhancing fibers having a three dimensional anfractuous character;

said other ply of tissue having a total dry breaking tensile strength (machine direction tensile strength plus cross direction tensile strength) of at least about 100 grams per pound per 3000 sq. ft. ream per 3 inch width, said embossed tissue product being point-to-point embossed to a depth of at least about 0.025 inch over at least about 10% of its area and exhibiting perceptibly improved softness relative to a comparable conventional water formed tissue having the same structure, overall fiber composition, basis weight and unembossed total dry breaking tensile strength, embossed to the same depth of emboss using the same embossing pattern, each of said water formed plies being of the same fiber composition, basis weight, percent crepe and unembossed total dry breaking tensile strength as the corresponding ply of the tissue product; and each said ply having a basis weight of from about 4 to about 20 pounds per 3,000 sq. ft. ream; an 8 ply caliper to 3000 sq. ft. basis weight ratio exceeding about 3.7 mils/pound of basis weight, calculated based on the thickness of 8 plies in mils divided by the basis weight of a single ply of a 3,000 sq. ft. ream in pounds.

64. An embossed, biological membrane contact compatible, tissue product comprising at least two foam-formed plies of tissue, each incorporating at least about 100 ppm of forming-loop-incorporated surfactant and having at least two strata defined therein, at least one exterior stratum of each ply comprising:

from at least about 60% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

no more than about 40% by weight of relatively long, strength-enhancing cellulosic fiber chosen from the group consisting of chemically pulped softwood fiber and chemi-thermo-mechanically pulped softwood fiber, and mixtures thereof; said strength-enhancing cellulosic fiber having a weight average fiber length of about 2 to about 4 mm, a coarseness of about 14 to about 28 mg/100 m;

at least one other stratum of each said foam-formed ply comprising:

no more than about 35% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

at least about 60% by weight of relatively long strength-enhancing cellulosic fiber chosen from the group consisting of chemically pulped softwood fiber and chemi-thermo-mechanically pulped softwood fiber and mixtures thereof; said strength-enhancing cellulosic fiber having a weight average fiber length of about 2 to about 4 mm.,and a coarseness of about 14 to about 28 mg/100 m;

optionally, up to about 30% by weight of bulk enhancing fibers having a three dimensional anfractuous character;

each said foam formed ply of tissue having: a total dry breaking tensile strength (machine direction tensile strength plus cross direction tensile strength) of at least about 50 grams per pound per 3000 sq. ft. ream per 3 inch width;

said embossed tissue being embossed with a pattern to a depth of at least about 0.020 inch over at least about 10% of its area and exhibiting a perceptible improvement in softness relative to a comparable conventional water formed tissue having the same structure, overall fiber composition, basis weight and unembossed total dry breaking tensile strength, embossed to the same depth of emboss using the same embossing pattern, each of said water formed plies being of the same fiber composition, basis weight, percent crepe and unembossed total dry breaking tensile strength as the corresponding ply of said embossed tissue comprising at least one foam formed ply; and each said ply having a basis weight of from about 4 to about 20 pounds per 3,000 sq. ft. ream; an 8 ply caliper to 3000 sq. ft. basis weight ratio exceeding about 3.7 mils/pound of basis weight, calculated based on the thickness of 8 plies in mils divided by the basis weight of a single ply of a 3,000 sq. ft. ream in pounds.

65. A multi-ply tissue product comprising at least two plies, at least one of which is a foam formed ply comprising:

at least about 100 ppm of forming-loop-incorporated surfactant;

from at least about 50% by weight to about 80% by weight of relatively short, high softness cellulosic fiber formed by chemical pulping of hardwood; said fibers having a weight average fiber length of between about 0.5 to about 2.2 mm, a coarseness of about 7 to about 14 mg of fiber per 100 meters of fiber length (mg/100 m);

from at least about 20% by weight to about 50% by weight of relatively long strength-enhancing cellulosic fiber chosen from the group consisting of chemically pulped softwood fiber and chemi-thermo-mechanically pulped softwood fiber and mixtures thereof; said strength-enhancing cellulosic fiber having a weight average fiber length of about 2 to about 4 mm, a coarseness of about 14 to about 28 mg/100 m;

optionally, up to about 30% by weight of bulk-enhancing fibers having a three dimensional anfractuous character;

said foam formed ply being calendered to a percent reduction in caliper of at least about 10%, the surface of said foam formed ply possessing a perceptible improvement in softness in relation to the softness of comparable conventional water formed tissue having the same structure, fiber composition, basis weight and uncalendered total dry breaking total tensile strength, calendered to the same reduction in caliper, each of said water formed plies being of the same fiber composition, basis weight, percent crepe and uncalendered total dry breaking tensile strength as the corresponding ply of said multi-ply tissue product; and each said ply having a basis weight of from about 4 to about 20 pounds per 3,000 sq. ft. ream; an 8 ply caliper to 3000 sq. ft. basis weight ratio exceeding about 3.7 mils/pound of basis weight, calculated based on the thickness of 8 plies in mils divided by the basis weight of a single ply of a 3,000 sq. ft. ream in pounds.

* * * * *

UNITED STATES PATENT AND TRADEMARK OFFICE

CERTIFICATE OF CORRECTION

PATENT NO. : 5,409,572
DATED : April 25, 1995
INVENTOR(S) : Thomas N. Kershaw, Anthony O. Awofeso, Frank D. Harper, Dinesh M. Bhat, John H. Dwiggins, Frederick W. Ahrens and Bruce W. Janda It is certified that error appears in the above-indentified patent and that said Letters Patent is hereby corrected as shown below:

Column 11, lines 40-45, change the Table:

| Method of Forming | Basis Weight | MD Caliper | CD Tensile | % MD Tensile | % CD Stretch | Stretch |
|---|---|---|---|---|---|---|
| Water | 16.8 | 70.2 | 946 | 464 | 11.2 | 4.8 |
| Foam | 16.6 | 71.2 | 926 | 496 | 14.6 | 4.9 |

to

| Method of Forming | Basis Weight | Caliper | MD Tensile | CD Tensile | % MD Stretch | % CD Stretch |
|---|---|---|---|---|---|---|
| Water | 16.8 | 70.2 | 946 | 464 | 11.2 | 4.8 |
| Foam | 16.6 | 71.2 | 926 | 496 | 14.6 | 4.9 |

Signed and Sealed this

Twenty-sixth Day of September, 1995

Bruce Lehman

*Attest:*

BRUCE LEHMAN

*Attesting Officer*

*Commissioner of Patents and Trademarks*